US007444097B2

(12) United States Patent
Suzuki et al.

(10) Patent No.: US 7,444,097 B2
(45) Date of Patent: Oct. 28, 2008

(54) AIR-CONDITIONED ELECTROPHOTOGRAPHIC IMAGE FORMING APPARATUS

(75) Inventors: Yasuo Suzuki, Shizuoka (JP); Satoshi Igari, Kanagawa (JP); Katsuaki Miyawaki, Kanagawa (JP); Yasushi Nakazato, Tokyo (JP); Takeo Suda, Tokyo (JP); Tetsuroh Miura, Tokyo (JP); Takeshi Saitou, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 10/460,152

(22) Filed: Jun. 13, 2003

(65) Prior Publication Data

US 2004/0013442 A1 Jan. 22, 2004

(30) Foreign Application Priority Data

Jun. 13, 2002 (JP) ..... 2002-172587

(51) Int. Cl.
*G03G 15/00* (2006.01)

(52) U.S. Cl. ..... 399/91; 399/94

(58) Field of Classification Search ..... 399/92, 399/94, 96, 91, 97

See application file for complete search history.

(56) References Cited

U.S. PATENT DOCUMENTS

| | | | | |
|---|---|---|---|---|
| RE30,897 | E * | 4/1982 | Yamamoto et al. | 399/93 |
| 4,409,309 | A * | 10/1983 | Oka | 430/65 |
| 5,481,339 | A * | 1/1996 | De Cock et al. | 399/93 |
| 6,198,890 | B1 * | 3/2001 | Liu et al. | 399/107 |
| 6,219,504 | B1 * | 4/2001 | Matsuzaki et al. | 399/92 |
| 6,336,013 | B1 | 1/2002 | Suda et al. | |
| 6,366,751 | B1 * | 4/2002 | Shakuto et al. | 399/159 |
| 6,381,435 | B2 | 4/2002 | Shinohara et al. | |
| 6,463,237 | B2 | 10/2002 | Suda et al. | |
| 6,470,169 | B2 | 10/2002 | Nakazato | |
| 6,560,414 | B2 | 5/2003 | Suda et al. | |
| 6,571,071 | B2 | 5/2003 | Kanoshima et al. | |
| 6,647,229 | B2 * | 11/2003 | Haraguchi et al. | 399/149 |
| 6,902,857 | B2 * | 6/2005 | Yagi et al. | 430/125 |
| 2002/0021912 | A1 * | 2/2002 | Tanaka et al. | 399/46 |
| 2002/0159789 | A1 * | 10/2002 | Kusaba et al. | 399/111 |
| 2003/0086722 | A1 * | 5/2003 | Nakazato et al. | 399/93 |

FOREIGN PATENT DOCUMENTS

| | | | |
|---|---|---|---|
| EP | 629931 | A1 * | 12/1994 |
| JP | 1-85841 | | 6/1989 |
| JP | 02253272 | A * | 10/1990 |
| JP | 2-298968 | | 12/1990 |
| JP | 3-56980 | | 3/1991 |

(Continued)

OTHER PUBLICATIONS

Computer translation of cited reference JP06-083153 to Hamamichi et al.*

*Primary Examiner*—Quana M Grainger
(74) *Attorney, Agent, or Firm*—Oblon, Spivak, McClelland, Maier & Neustadt, P.C.

(57) ABSTRACT

An electrophotographic image forming apparatus of the present invention includes a frame, a photoconductive drum disposed in the frame, and an air conditioning device for removing moisture around the drum inside the frame. The drum has a wear-resistant, durable surface layer that wears by an amount of 0.05 μm to 0.5 μm for 100,000 rotations.

25 Claims, 25 Drawing Sheets

FOREIGN PATENT DOCUMENTS

| | | | | |
|---|---|---|---|---|
| JP | 6-83153 | | | 3/1994 |
| JP | 6-82234 | | | 10/1994 |
| JP | 7-72770 | | | 3/1995 |
| JP | 7-225541 | | | 8/1995 |
| JP | 10-254291 | | | 9/1998 |
| JP | 2000098829 | A | * | 4/2000 |
| JP | 2000-321806 | | | 11/2000 |
| JP | 2001-142241 | | | 5/2001 |
| JP | 2001-235989 | | | 8/2001 |
| JP | 2001-265096 | | | 9/2001 |
| JP | 2002-23392 | | | 1/2002 |
| JP | 2002-82515 | | | 3/2002 |
| JP | 2003254556 | A | * | 9/2003 |

* cited by examiner

FORMULA (1)

FORMULA (2)

FORMULA (3)

FORMULA (4)

FORMULA (5)

FORMULA (6)

FORMULA (7)

FORMULA (8)

FORMULA (9)

FORMULA (10)

FORMULA (11)

FORMULA (12)

$$(R)_n - Si - (X)_{4-n}$$

FORMULA (13)

$$A - (Z)_m$$

FORMULA (14)

FORMULA (15)

FORMULA (16)

FORMULA (17)

FORMULA (18)

FORMULA (19)

FORMULA (20)

FORMULA (21)

FORMULA (22)

FORMULA (23)

FORMULA (24)

FORMULA (25)

FORMULA (26)

FIG. 35

| DRUM NO. | AIR NON CONDITIONED | | AIR CONDITIONED | | WEAR FOR 100,000 ROTATIONS (μm) |
|---|---|---|---|---|---|
| | 100,000 ROTATIONS | 200,000 ROTATIONS | 100,000 ROTATIONS | 200,000 ROTATIONS | |
| 1 | BACKGROUND SLIGHTLY CONTAMINATED | BACKGROUND CONTAMINATED | BACKGROUND SLIGHTLY CONTAMINATED | BACKGROUND CONTAMINATED | 1.50 |
| 2 | BACKGROUND SLIGHTLY CONTAMINATED | BACKGROUND CONTAMINATED | BACKGROUND SLIGHTLY CONTAMINATED | BACKGROUND CONTAMINATED | 1.00 |
| 3 | GOOD | BACKGROUND CONTAMINATED | GOOD | BACKGROUND CONTAMINATED | 0.65 |
| 4 | GOOD | BLUR | GOOD | GOOD | 0.50 |
| 5 | BLUR | BLUR | GOOD | GOOD | 0.25 |
| 6 | BLUR & TONER FILMING | BLUR & TONER FILMING | GOOD | GOOD | 0.10 |
| 7 | BLUR & TONER FILMING | BLUR & TONER FILMING | GOOD | GOOD | 0.05 |
| 8 | BACKGROUND CONTAMINATED | BACKGROUND CONTAMINATED | BACKGROUND CONTAMINATED | BACKGROUND CONTAMINATED | 2.00 |
| 9 | BACKGROUND CONTAMINATED | GOOD | GOOD | GOOD | 0.23 |
| 10 | BACKGROUND CONTAMINATED | GOOD | GOOD | GOOD | 0.20 |
| 11 | GOOD | GOOD | GOOD | GOOD | 0.35 |
| 12 | GOOD | GOOD | GOOD | GOOD | 0.35 |
| 13 | BLUR | BLUR & TONER FILMING | GOOD | GOOD | 0.18 |
| 14 | BLUR | BLUR | GOOD | GOOD | 0.25 |
| 15 | GOOD | BLUR | GOOD | GOOD | 0.30 |
| 16 | BLUR & TONER FILMING | BLUR & TONER FILMING | BLUR | BLUR & TONER FILMING | 0.03 |
| 17 | LEAK IMAGE | LEAK IMAGE | GOOD | GOOD | 0.50 |
| 18 | BLUR | BLUR | GOOD | GOOD | 0.25 |
| 19 | BLUR & TONER FILMING | BLUR & TONER FILMING | GOOD | GOOD | 0.10 |
| 20 | BLUR | BLUR & TONER FILMING | GOOD | GOOD | 0.12 |

AIR-CONDITIONED ELECTROPHOTOGRAPHIC IMAGE FORMING APPARATUS

BACKGROUND OF THE INVENTION

1. Field of the Invention

The present invention relates to a copier, printer, facsimile apparatus or similar electrophotographic image forming apparatus.

2. Description of the Background Art

It is a common practice with an image forming apparatus to uniformly charge the surface of a photoconductive drum or image carrier, scanning the charged surface of the drum with a light beam in accordance with image data to thereby form a latent image, and develop the latent image with toner to thereby produce a corresponding toner image. The toner image is then transferred from the drum to a sheet or recording medium. After the image transfer, toner left on the drum is removed.

While discharge is, in many cases, used for the purpose of uniformly charging the surface of the drum, the problem with discharge is that it generates nitric acid compounds. When nitric acid compounds are coupled with moisture present in air, there are generated nitric acid, nitrate and other ionic substances. Further, such ionic substances react with ammonia present in air, generating ammonium nitrate.

When the ionic substances and ammonium nitrate, which are apt to deposit on the drum, deposit on the drum, they accelerate the deterioration of the drum to thereby bring about the unusual wear of the drum. Further, the ionic substances make the surface of the drum electrically conductive, causing a latent formed on the above surface to blur or run.

Toner filming to occur on the surface of the drum is another causes of a defective image. More specifically, first, a wax component and a resin component contained in toner deposits on the drum surface, and then paper dust, which easily absorbs moisture, deposits on the wax component and resin component. Subsequently, the ionic substances deposit on the paper dust absorbed moisture, forming a film on the drum surface. Such toner filming is likely to cause an image formed on the drum to run.

In light of the above, it has been customary to cause the surface of the drum to wear with a cleaning blade, which contacts the above surface, for thereby removing the ionic substances, ammonium nitrate and toner filming. This, however, brings about another problem that because the surface layer of the drum is worn by 2 μm to 3 μm for 100,000 rotations, the durability and therefore the life of the drum is reduced although image quality may be enhanced.

To solve the above problem, the surface layer of the drum may be increased in hardness and wear resistance to reduce the amount of wear for thereby increasing durability, as proposed in the past. However, it is difficult to sufficiently shave oft the ionic substances, ammonium nitrate and toner filming from such a hard, highly wear-resistant surface and therefore to sufficiently cope with the unusual wear of the above surface and image running. As a result, image quality is lowered.

In the circumstances described above, when use is made of a drum whose surface layer is increased in hardness and wear resistance for enhancing durability, some special means for removing the ionic substances, ammonium nitrate and toner filming from the above surface layer must be used. For example, means for increasing the pressure of a cleaning blade acting on the drum at preselected timing is essential. It is difficult to arrange such special means in a limited space available around the drum.

On the other hand, an electrophotographic image forming apparatus in which a drum heater is accommodated in a drum for heating the drum has been proposed in order to obviate image running particular to the highly durable, highly wear-resistant drum surface. Although heating the drum is successful to reduce image running, the diameter of the drum must be made large enough to accommodate the drum heater. This is contradictory to the current trend toward the size reduction of an electrophotographic image forming apparatus.

Technologies relating to the present invention are disclosed in, e.g., Japanese Patent Publication No. 6-82234 and Japanese Patent Laid-Open Publication Nos. 7-72770, 7-225541 and 2000-321806.

SUMMARY OF THE INVENTION

It is therefore an object of the present invention to provide an electrophotographic image forming apparatus capable of using a highly wear-resistant, highly durable photoconductive drum and yet enhancing image quality without resorting to any additional means around the drum.

BRIEF DESCRIPTION OF THE DRAWINGS

FIG. 35 is a table comparing specific examples of the present invention as to the amount of wear and image quality.

DESCRIPTION OF THE PREFERRED EMBODIMENTS

Figure 1:
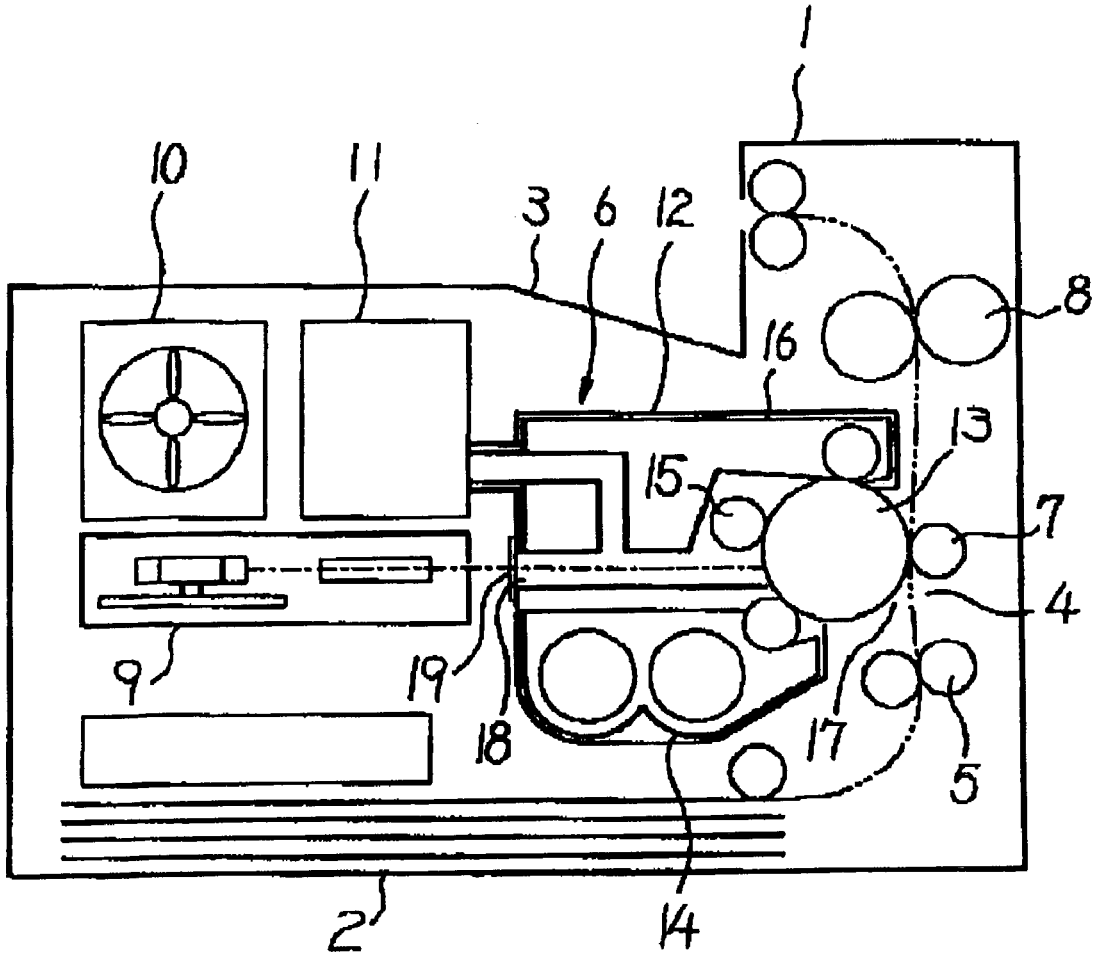
FIG. 1 is a sectional front view showing a first embodiment of the electrophotographic image forming apparatus in accordance with the present invention.
Figure 2:
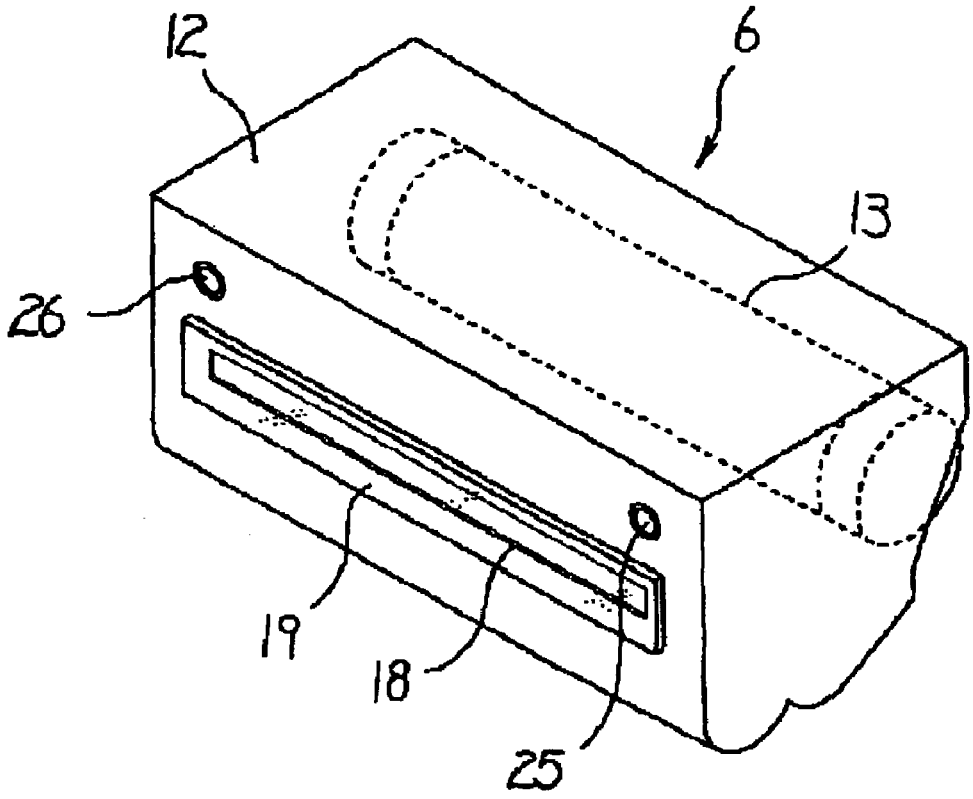
FIG. 2 is a perspective view showing an image forming module included in the first embodiment.

Referring to FIGS. 1 through 5, a first embodiment of the electrophotographic image forming apparatus in accordance with the present invention will be described. As shown, the image forming apparatus includes a frame 1 in which a path 4 for conveying a sheet or recording medium extends from a sheet feeding section 2 to a sheet discharging section 3. The sheet feeding section 2 is loaded with a stack of sheets. A registration roller pair 5, an image forming module 6, an image transferring unit 7, a fixing unit 8 and other process units are arranged along the path 4. An optical writing unit 9 scans a photoconductive drum or image carrier 13 with a laser beam in accordance with image data, thereby forming a latent image on the drum 13. An exhausting device 10 exhausts the frame 1 of the apparatus while air conditioning device 11 removes moisture present in the image forming module 6.

The image forming module 6 has a case 12 accommodating the drum 13, developing unit 14, a charger 15, and a cleaning unit 16.

The exhausting device 11 discharges heat generated by, e.g., a heat source included in the fixing unit 8 and nitric acid compounds ascribable to the discharge of the charger 15 to the outside of the frame 1. When the exhausting device 11 exhausts the frame 1 of part of air present in the frame 1, outside air flows into the frame 1 via a slit, not shown, formed in the frame 1 in an amount corresponding to the amount of discharged air.

The case 12 of the image forming module 6 is formed with an opening 17 for transferring a toner image from the surface of the drum 13 to a sheet. The opening 17 is the only opening that may allow moisture to enter the image forming module 6 from the outside. Stated another way, the space inside the image forming module 6 is substantially hermetically closed. While a slit 18 is formed in the case 12 for allowing the laser beam issuing from the writing unit 9 to reach the drum 13, the slit 18 is covered with a glass, resin or similar transparent plate 19, so that the hermetic closing of the image forming module 6 is further enhanced. It is to be noted that substantially hermetic closing mentioned above is of such a degree that the removal of moisture by the air conditioning means 11 can be effected independently of the outside of the image forming module 6. That is, the substantially hermetically closed space does not refer to a space that fully obviates the ingress and egress of air.

Figure 3:
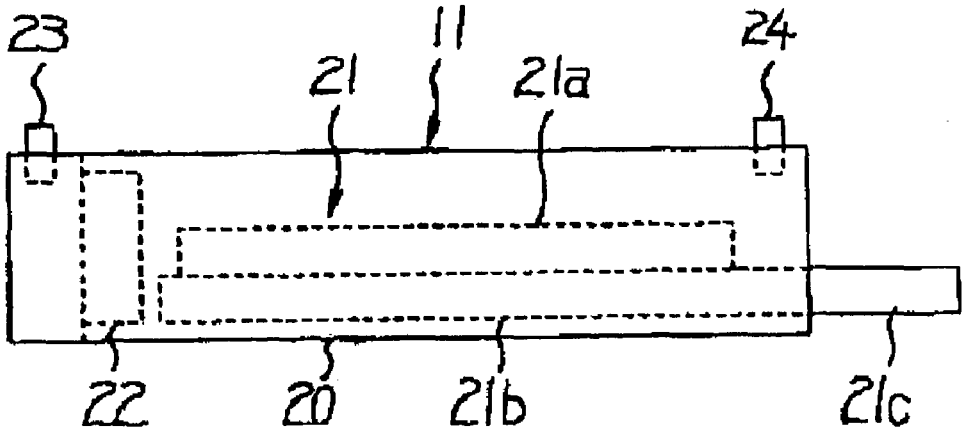
FIG. 3 is a view showing an air conditioning device also included in the illustrative embodiment.

As shown in FIG. 3, the air conditioning device 11 includes a case 20, a dehumidifier 21 and a pump 22 accommodated in the case 20, and an inlet port 23 and an outlet port 24 formed in the case 20. The dehumidifier 21 is made up of a Pertier device or similar cooling and condensing means 21*a* and adsorbing and conveying means 21*b* for conveying condensed dew to the outside of the case 20. The adsorbing and conveying means 21*b* is implemented as a bundle of fibers. Part of the adsorbing and conveying means 21*b* protruding to the outside of the case 20 serves as an evaporating portion 21*c*.

Figure 4:
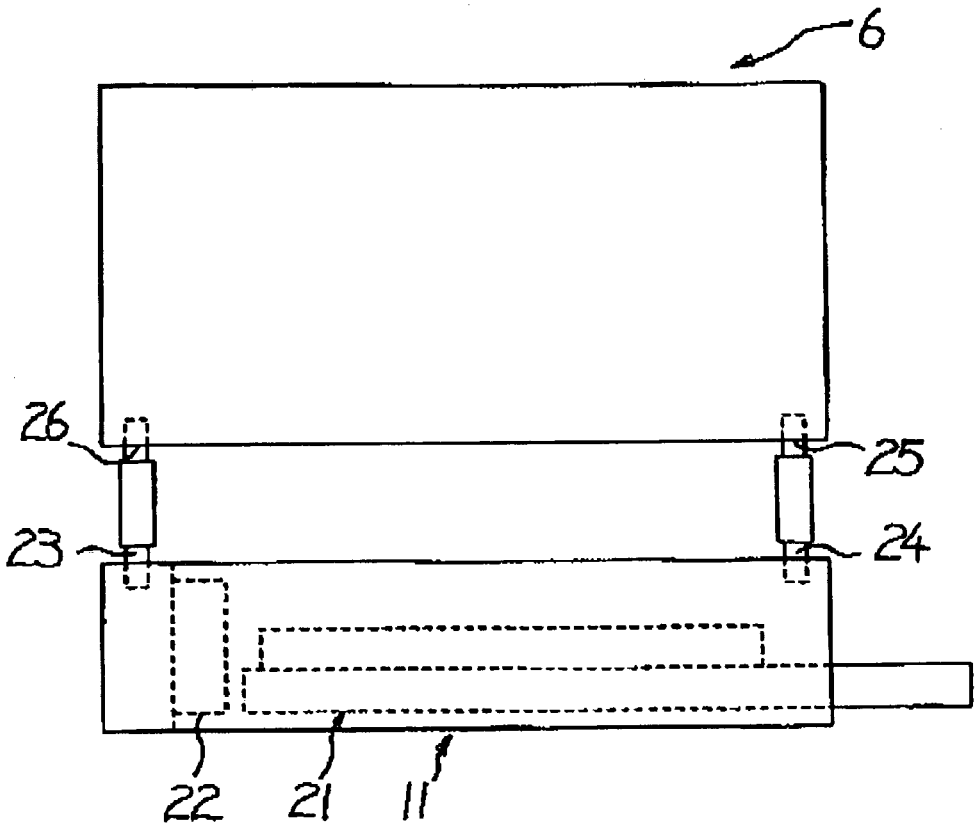
FIG. 4 is a view showing connection between the image forming module and the air conditioning device.

As shown in FIG. 4, air dehumidified by the air conditioning means 11 and discharged via the outlet port 24 flows into an inlet port 25 formed in the image forming module 25. An outlet port 26 is also formed in the image forming module 6 for discharging air inside the module 6 to the outside of the module 6. More specifically, when the pump 22 is driven, air flown into the air conditioning device 11 via the inlet port 23 is dehumidified by the dehumidifier 21 and then discharged via the outlet port 24 to flow into the image forming module 6 via the inlet port 25. Air thus entered the image forming module 6 is circulated in the module 6 and then discharged via the outlet port 26.

Figure 5:
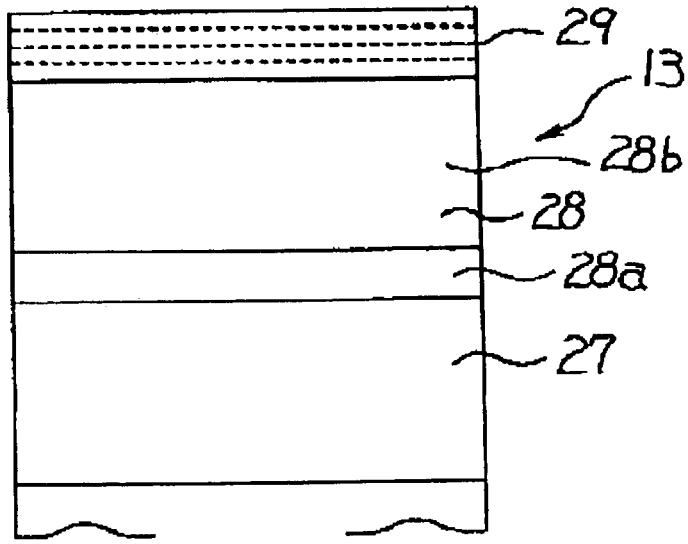
FIG. 5 is a section showing the structure of a photoconductive drum included in the illustrative embodiment.

In the illustrative embodiment, the drum 13 has a surface layer that wears by 0.05 μm to 0.5 μm for 100,000 rotations. More specifically, as shown in FIG. 5, the drum 13 is made up of a tubular conductive base 27 located at the center, a photoconductive layer 28 formed on the outer periphery of the base 27, and a protection layer or surface layer 29 formed on the outer periphery of the photoconductive layer 28. The photoconductive layer 28 is a stack of a charge generating layer 28*a* containing a charge generating substance and a charge transporting layer 28*b* containing a charge transporting substance.

It is to be noted that the amount of wear for 100,000 rotations mentioned above does not mean the actual amount of wear at the 100,000th rotation, but means an amount converted from the amount of wear to occur when the drum 13 reaches its upper limit of rotation, e.g., 200,000 rotations. Also, the charge generating substance and charge transporting substance respectively refer to a substance that generates free carriers when illuminated and a substance that transports the free carriers.

As for the conductive base 27, use may be made of film-like or cylindrical plastic or paper coated with an electric conductive material having volumetric resistance of $10^{10}$ Ω·cm or below, e.g., a metal such as aluminum, nickel, chromium, nichrome, copper, gold, silver or platinum, or metallic oxide such as tin oxide or indium oxide by evaporation or spattering, or a plate such as aluminum, an aluminum alloy, nickel or stainless steel or pipes manufactured by extruding or drawing these materials, subjected to surface treatment such as cutting, superfinishing and polishing. An endless nickel belt or an endless stainless steel belt disclosed in Japanese Patent Laid-Open Publication No. 52-36016 can be used as the conductive support.

The above-mentioned film-like or cylindrical plastic or paper coated with a conductive layer made by dispersing electric conductive powder in an appropriate binder resin can be also used as the conductive base 27 of this implement. As the conductive powder, carbon black, acetylene black, or metallic powder such as aluminum, nickel, iron, nichrome, copper, zinc or silver, or metallic oxide powder, such as conductive tin oxide or indium tin oxide (ITO) are listed. As the binder resin simultaneously used, the following thermoplastic, thermosetting or photo-setting resins are listed: polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, acetic cellulose resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin. These conductive layers can be formed by dispersing these conductive powders and binder resins in a proper solvent, such as tetrahydrofuran, dichloromethane, methyl ethyl ketone or toluene for coating.

Further, conductive layers formed by including the above conductive powders in a heat-shrinking tube made of a material of a cylindrical base such as polyvinyl chloride, polypropylene, polyester, polystyrene, polyvinylidene chloride, polyethylene, chlorinated rubber, and polyethylene fluoride, can be satisfactorily used as the conductive base 27 of the present implement.

The photoconductive layer 28 will be described specifically hereinafter. While the photoconductive layer 28 may be implemented as either one of a single layer or a laminate, the layer 28 made up of the charge generating layer 28*a* and charge transporting layer 28*b* will be described first.

The charge generating layer 28*a* is a layer having the charge generating substance as a major component and is formed by dispersing the charge generating substance in a proper solvent, together with the binder resin if necessary, using a ball mill, Atliter (R), sand mill or supersonic wave, coating it to the conductive base 27 and drying.

All the known charge generating substances can be used for the charge generating layer 28*a*, represented by: phthalocyanine-based pigment such as titanyl phthalocyanine, vanadyl phthalocyanine, copper phthalocyanine, hydroxy gallium phthalocyanine, and non-metallic phthalocyanine, azo pigment such as monoazo pigment, disazo pigment, asymmetric disazo pigment, tris azo pigment, perylene-based pigment, perynone-based pigment, indigo pigment, pyrroropyrrole pigment, anthraquinone pigment, quinacridone-based pigment, quinone-based condensed polycyclic compound, squarium pigment. These known materials can be usefully employed. These charge generating substances can be used in a single form or in a mixed form of two or more types.

As for the binder resin used for the charge generating layer 28*a* when necessary, use may be made of the following substances: polyamide, polyurethane, epoxy resin, polyketone, polycarbonate, silicone resin, acrylic resin, polyvinyl butyral, polyvinylformal, polyvinyl ketone, polystyrene, polysulfon, poly-N-vinylcarbazole, polyacrylamide, polyvinylbenzal, polyester, phenoxy resin, vinyl chloride-vinyl acetate coplymer, polyvinly acetate, polyphenylene oxide, polyamide, polyvinyl pyridine, cellulose-based resin, casein, polyvinyl alcohol, and polyvinyl pyrrolidon. The suitable amount of the binder resin is 1 part by weight to 500 parts by weight, preferably 10 parts by weight to 300 parats by weight, for 100 parts by weight of the charge generating substance. The binder resin can be added before or after dispersion.

Following substances are listed as the solvent used here: isopropanol, acetone, methyl ethyl ketone, cyclohexanone, tetrahydrofuran, dioxane, ethyl cellusolve, ethyl acetate, methyl acetate, dichloromethane, dichloroethane, monochlorobenzene, cyclohexane, toluene, xylene, lygroin, or the like. Particularly, a ketone-based solvent, ester-based solvent and ether-based solvent are satisfactorily used. These can be used in a single torm, or in a mixed form of two or more types.

The charge generating layer 28*a*, as mentioned above, has the charge generating substance, solvent and binder resin as the principal components, among which, an additive such as, a sensitizer, dispersant, surfactant or silicone oil, can be included.

The coating method of the coating liquid for forming the charge generating layer 28*a* includes those methods, such as, dipping coating, spray coating, beat coating, nozzle coating, spinner coating and ring coating. The film thickness of the charge generating layer 28*a* is suitably 0.01 μm to 5 μm, preferably 0.1 μm to 2 μm.

The charge transporting layer 28*b* can be formed by dissolving or dispersing the charge transport substance and the binder resin into a proper solvent, coating it on the charge generating layer 28*a*, and drying it. When necessary, addition of a single or two or more plasticizer, leveling agent, antioxidant or lubricant, is possible and useful.

The charge transport substance is classified into a hole transport substance and an electronic transport substance. The electronic transport substance is an electron receiving substance, such as, chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-4H-indeno[1,2-b] thiophene, 1,3,7-trinitrodibenzothiophene-5, 5-dioxide, and bezoquinone-4-one, derivatives.

The following substances ate listed as the hole transport substance: poly-N-vinylcarbazole and its derivatives, poly-γ-carbazole ethylglutamate and its derivatives, pyrene-formaldehyde condensate and its derivatives, polyvinylpyrene, polyvinylphenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styril anthracene derivatives, pyrazoline derivatives, divinyl-benzene derivatives, hydrazone derivatives, indene derivatives, butadiene derivatives, pyrene derivatives, bisstilbene derivatives, enamine derivatives, and other known materials. These charge transport substances (the hole transport substance and the electronic transport substance) can be used in a single form or in a mixed form of two or more types.

The following thermoplastic or thermosetting resins are listed as the binder resin: polystyrene, styrene-acrylonitrile copolymer, styrene-butadiene copolymer, styrene-maleic anhydride copolymer, polyester, polyvinyl chloride, vinyl chloride-vinyl. acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane;resin, phenol resin, and alkyd resin.

The suitable amount of the charge transport substance is 20 parts by weight to 300 part by weight, preferably 40 parts by weight to 150 parts by weight for 100 parts by weight of the binder resin. The film thickness of the charge transporting layer is preferably below 30 μm from the point of the resolution and responsiveness. The lower limit value varies depending on the system used (particularly on the charged potential), and is preferably higher than 5 μm.

As the solvent used here, tetrahydroturan, dioxane, dioxorane, toluene, dichloromethane, monochlorobenzene, dichloroethane, cyclohexannone, methyl ethyl ketone, or acetone is used. These can be used in a single form or in a mixed form of two or more types.

The charage transporting layer 29 is preferably provided on the photoconductive layer 28 as a surface layer of the photoconductive layer 13 or improving the durability and anti-abrasiveness. Any substance satisfying the abrasive conditions indicated in this embodiment (abraded amount to be 0.05 μm to 0.5 μm for 100,000 rotations) can be used. Following layers are listed as the transporting layer: a layer containing hole transporting hydroxyarylamine having a hydroxy functional group and a polyamide film-forming binder capable of forming a hydrogen bonding with the hydroxy functional group (Japanese Patent Laid-Open Publication No. 7-253683), a film coated with a substance prepared by adding a hydroxyarylamine compound having a hydroxy functional group and a curing catalyst into a thermosetting polyamide resin, followed by heating setting after coating (U.S. Pat. No. 5,670,291), a cured layer using a charge transport compound containing an alkoxysilile group and an alkoxysilane compound (Japanese Patent Laid-Open Publication No. 3-191358), a cured layer using organopolysiloxane and colloidal silica, and a conductive metallic oxide and an acrylic resin (Japanese Patent Laid-open Publication No. 8-95280), a layer having a conductive metallic oxide cross-linked with an acrylic ester having a silica functional group (Japanese Patent Laid-Open Publication No. 8-160651), a layer having a conductive metallic oxide cross-linked with a photosetting acrylic monomer or an oligomer (Japanese Patent Laid-open Publication No. 8-184980), a layer cured by using a charge transport compound containing an epoxy resin (Japanese Patent Laid-Open Publication No. 8-278645), a crystallizing carbon layer having a diamond-like carbon having hydrogen, or an amorphous carbon or fluorine (Japanese Patent Laid-Open Publication Nos. 9-101625, 9-160268 and 10-73945), a layer having cyanoethyl pullulan as a principal component (Japanese Patent Laid-open Publication No. 9-90650), a layer having a silyl acrylate compound cross-linked with colloidal silica (Japanese Patent Laid-Open Publication No. 9-319130), a layer using a polycarbonate-based graft copolymer (Japanese Patent Laid-open Publication No. 10-63026), a layer with cured colloidal silica particles and a siloxane resin (Japanese Patent Laid-Open Publication No. 10-83094), and a layer cured by using a charge transport compound containing a hydroxyl group and an isocyanate group-containing compound (Japanese Patent Laid-open Publication No. 10-177268).

Among these, suitable ones as the surface layers of the drum 13 from the points of practicability, cost and affect on the sensitivity, are the transporting layers 29 containing at least filler in the binder resin, the transporting layers 29 formed by using at least one kind of the cross-linking compounds, and charge injected layers with $1\times10^{8}$ Ω·cm to $1\times10^{14}$ Ω·cm of the volumetric resistance. The "filler" means a substance added for improving the durability and hardness of the material for containing the filler.

The filler contained in the charge transporting layer 29 will be described hereinafter. An organic filler and an inorganic tiller are used as the filler. As the organic filler, fluorine resin powder such as polytetrafluoroethylene, silicone resin powder, a-carbon powder are listed. As the inorganic filler, the following inorganic materials are listed: metallic powder such as copper, tin, aluminum or indium, silica, metallic oxide such as, tin oxide, zinc oxide, titanium oxide, alumina, zirconia, indium oxide, antimony oxide, bismuth oxide, calcium oxide, tin oxide doped with antimony, or indium oxide doped with tin, metallic fluoride such as, tin fluoride, calcium fluoride, or aluminum fluoride, potassium titanate, or boron nitride. Among these fillers, the inorganic materials, particularly the metallic oxides are advantageously used for the anti-abrasive property or high image quality from the points of the filler hardness and light dispersiveness. Further, the use of the metallic oxides are advantageous for the coating film quality. The coating film quality has a large influence on the image quality and anti-abrasiveness, acquisition of superior coating film is effective for the high durability and high image quality.

Among these metallic oxides, a filler having a high electric insulating property is preferable, as the filler causing little blur. In the case of including the conductive filler in the surface layer of the drum, lateral movement of the charge occurs due to the decrease of the surface resistance, resulting in easy occurrence of the image blur. Particularly, the specific resistance of the filler is preferably higher than $10^{10}$ Ω·cm from the point of the resolution, for such a filler, alumina, zirconia, titanium oxide and silica are listed. On the other hand, as the conductive fillers having the specific resistance below $10^{10}$ Ω·cm or fillers having relatively low specific resistance, tin oxide, zinc oxide, indium oxide, antimony oxide, tin oxide doped with antimony, and indium oxide doped with tin are given. They are not preferable in the present implement, since image blur is liable to occur. Even if the fillers have the same material, the specific resistance can be different, therefore, the fillers cannot be completely classified by the kind of the fillers. It is important to classify on the basis of the specific resistance of the fillers. The fillers can be used by mixing two or more kinds of the fillers, thereby the surface resistance can be controlled.

To reduce the blur of an image, the filler should preferably have pH of 5 or above at the equipotential point and should preferably have higher basicity. A filler dispersed in a liquid is charged to positive or negative polarity and is therefore apt to effect the stability of the filler grains and resolution. A filler having higher basicity at the equipotential point effectively reduces the blur of an image because of its chargeability and resistance. Metal oxides whose pH is 5 or above include, among the fillers stated earlier, titanium oxide, zirconia and alumina. Particularly, alumina is desirable because basicity increases in the order of titanium oxide, ziroconia and alumina. Further, α type alumina is more desirable in reducing the blur of an image and improving wear resistance as well as coating quality and transmittance because this type of alumina has high transmittance, high stability against heat, and a hexagonal closest structure.

When the refractive index of the filler is less than 1.0 or is 2.0 or above, the transmittance of the protection layer decreases with the result that the reproducibility of dots, forming a latent image, is lowered to degrade image quality. For example, filler grains may be immersed in a liquid that can vary the refractive index little by little, in which case the refractive index of the filler will be produced from the refractive index of the liquid that makes the surfaces of the grains unclear. To measure the refractive index of the liquid, use may be made of, e.g., an Abbe refractometer.

The surfaces of the filler grains may be treated with at least one kind of surface treating agent. As for the drum 13 whose surface layer or protection layer 29 contains the filler, the blur of an image ascribable to ozone and NOx (nitrogen oxides) may be brought about when such gases are adsorbed by the surfaces of filler grains. The surface treading agent can vary the specific resistance and equipotential-point pH of the filler and can therefore sometimes reduce the blur of an image to a noticeable degree. Further, the surface treating agent promotes the dispersion of the filler for thereby enhancing transparency of a coated layer, reducing defective coating, increasing wear resistance, and reducing local wear.

While any one of conventional surface treating agents is usable, it is preferable to use a surface treating agent capable of maintaining the specific resistance and equipotential-point pH mentioned earlier. The equipotential-point of the filler can be varied by surface treatment. More specifically, the equipotential point of the filler shifts to the acid side when treated with an acid surface treating agent or shifted to the basic side when treated with a basic surface treating agent. In this sense, in the illustrative embodiment, use should preferably be made of a basic surface treating agent in order to promote dispersion and reduce the blur of an image. For example, a titanic coupling agent, an aluminum coupling agent and a zircoaluminate coupling agent are particularly desirable. Also desirable from the above standpoint are $Al_2O_3$, $TiO_2$, $ZrO_2$, silicone, aluminum stearate or a mixture thereof. While a silane coupling agent has substantial influence on the blur of an image, the influence can sometimes be reduced if a silane coupling agent is mixed with the surface treating agent. Also, even a filler whose pH at the equipotential point is less than 5 allows the advantages of the present invention to be achieved if the basic surface treating agent is used.

The mean primary grain size (mean grain size of a minimum unit) of the filler should preferably be between 0.01 μm and 0.9 μm, more preferably between 0.1 μm and 0.5 μm, from the transmittance and wear resistance standpoint. If the mean primary grain size is smaller than 0.01 μm, then not only the filler is apt to cohere or the wear resistance of the filler is apt to decrease, but also the influence on the blur of an image is sometimes aggravated due to an increase in the specific surface area of the filler. If the mean primary grain size is larger than 0.9 μm, then it is likely that the sedimentation of the filler is aggravated or that image degradation or a defective image occurs.

To obstruct an increase in residual potential ascribable to the filler, a carboxylic acid compound may be added to the filler, In the illustrative embodiment, the carboxylic acid compound may be either one of a 100% nonvolatilized compound or a compound dissolved in, e.g., an organic solvent beforehand.

For these carboxylic acids, any compound such as, generally known organic aliphatic acids and high acid value resins or copolymers can be used which contain a carboxylic group in their molecular structure. For example, the saturated aliphatic acids and unsaturated aliphatic acids such as, lauric acid, stearic acid, arachidic acid, behenic acid, adipic acid, oleic acid, maleic acid, maleic anhydride, salicylic acid, phthalic acid, isophthalic acid, terephthalic acid, pyromellitic acid, and any carboxylic acid such as aromatic carboxylic acid can be used. Further, any polymer, oligomer or copolymer are included which have the saturated or. unsaturated hydrocarbon as the basic structure, such as, saturated polyester, unsaturated polyester, polyester with unsaturated terminal carboxylic acid, or acrylic acid, methacrylic acid, acrylic ester, methacrylic ester, styrene-acrylic acid copolymer, styrene-acrylic acid-acrylic ester copolymer, styrene-methacrylic acid copolymer, styrene-methacrylic acid-acrylic ester copolymer, styrene-maleic acid copolymer, styrene-maleic anhydride, and have at least one or more carboxyl groups bonded thereto. They are further effectively used, since they have not only the effect of suppressing the increase of the residual potential, but the effect of improving the dispersiveness of the filler. Among these carboxylic acid compounds, a polycarboxylic acid compound having a plurality of carboxylic residues has a high acid value, and has a tendency of improving the adsorbing property to the filler, therefore, it is particularly effective and useful for decreasing the residual potential and improving the dispersiveness of the filler.

Why the carboxylic acid compound reduces residual potential is presumably that such a compound has an acid value and thatit can be adsorbedbythe filler The filler increases residual potential presumably because a polar group on the filler surface constitutes a charge trapping site. Presumably, a carboxyl group is easily adsorbed by the polar group of the filler, enhancing the reduction of residual potential. Further, by providing the carboxylic acid compound with affinity to both of the filler and binder resin for enhancing wettability and subjecting it to steric hindrance or electric repulsion, it is possible to reduce interaction between filler grains and therefore to enhance stability, thereby promoting the dispersion of the filler.

The dispersant should preferably be added by an amount satisfying the following relation in accordance with the acid value of the dispersant:

$$0.1 \leq (\text{amount of dispersant} \times \text{acid value of dispersant}) / (\text{amount of filler}) \leq 20$$

However, the amount of the dispersant should preferably be the minimum necessary amount. The amount of the dispersant would influence the blur of an image if excessively large or would obstruct the enhancement of dispersion or the reduction of residual potential and thereby render an image defective if excessively small.

All the above-mentioned binder resins used for the charge transporting layer 28*b* can be used for the binder resins contained in the transporting layer 29, while it is important not to have adverse influence on the filler dispersiveness, since the dispersiveness of the fillers is affected by the type of the binder resin. The resin having an acid value is useful for decreasing the residual potential, and can be used for all the binder resins, or be added to part of the binder resin by mixing with other binder resin. Useable resins or copolymers are as follows: polyester, polycarbonate, acrylic resin, polyethylene terephthalate, polybutylene terephthalate, various copolymers using acrylic acid and methacrylic acid, styrene-acryl copolymer, polyallylate, polyacrylate, polystyrene, epoxy resin, ABS resin, ACS resin, olefin-vinyl monomer copolymer, chlorinated polyether, aryl resin, phenol resin, polyacetal, polyamide, polyamide imido, polyallylsulfon, polybutylene, polyether sulfon, polyethylene, polyimide, polymethylbentene, polypropylene, polyphenylene oxide, polysulfon, AS resin, butadiene-styrene copolymer, polyurethane, polyvyinyl chloride, and polyvinylidene chloride. These materials can be used in a single form, or in a mixed form by mixing two or more of them.

Because the binder resin has noticeable influence on the blur of an image, the binder resin highly resistant to NOx and ozone not only reduces blur, but also increases wear resistance. While such binder resin may be advantageously be implemented by a polymer alloy, at least polyethylene terephthalate and polymer alloy are effective to reduce blur.

In the illustrative embodiment, the protection layer 29 should preferably contain at least one kind of charge transporting substance for reducing residual potential. While the charge transporting substances applied to the charge transporting layer 28*b* all are applicable to the protection layer 29 also, the charge transporting agent of the protection layer 29 and that of the charge transporting layer 28*b* may be different from each other.

Figure 9:
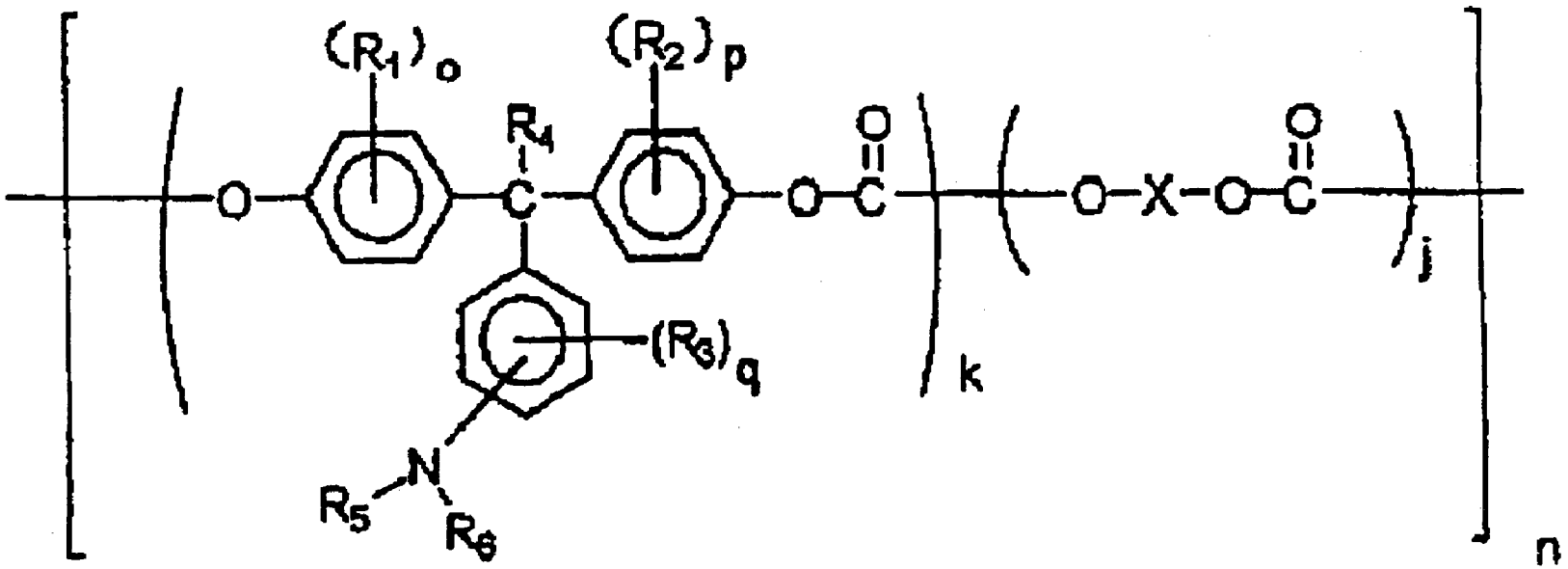
FIGS. 9 through 34 show chemical formulae relating to the illustrative embodiments of the present invention.
Figure 10:
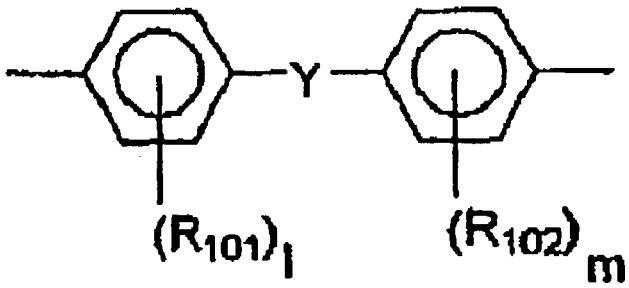
Figure 11:
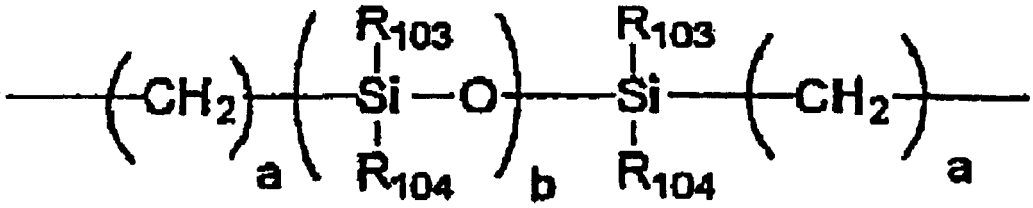

High polymer charge transport substances having a function as the charge transport substance and a function as a binder resin are satisfactorily used for the transporting layer 29. The charge transporting layer composed from these high polymer charge transport substances has superior anti-abrasiveness. Known material can be used for the high polymer charge transport substances, particularly polycarbonate containing triarylamine structure in at least one of the main chain and the side chain is satisfactorily used. Among them, the high polymer charge transport substances expressed by chemical formulas (1)-(12) shown in FIGS. 9-20 are satisfactorily used. The actual examples are explained below:

$R_1$, $R_2$, $R_3$ in formula (1) shown in FIG. 9 are each independent substituted or unsubstituted alkyl groups or halogen atoms; $R_4$ is a hydrogen atom or substituted or unsubstituted alkyl group; $R_5$, $R_6$ are each substituted or unsubstituted aryl groups; o, p and q are each independent integers of 0-4; k and j represent the composition, and $0.1 \leqq k \leqq 1$ and $0 \leqq j \leqq 0.9$; n is a repeating unit number, and is an integer 5-5,000. X is a bivalent group of an aliphatic group, bivalent group of a cyclic aliphatic group, or a bivalent group expressed by formula (2) as a general formula shown in FIG. 10.

In formula (2), $R_{101}$, $R_{102}$ are each independent substituted or unsubstituted alkyl groups, aryl groups or halogen atoms. l and m are each integers of 0-4; Y is a single bonding, 1-12C straight, branched or cyclic alkylene group, —O—, —S—, —SO—, —$SO_2$—, —CO—, —CO—O—Z—O—CO— (Z is a bivalent group of an aliphatic group), or formula (3) shown in FIG. 11.

In formula (3), a is an integer of 1-20, b is an integer of 1-2,000; $R_{103}$ and $R_{104}$ are each substituted or unsubstituted alkyl group or aryl group. $R_{101}$ and $R_{102}$, $R_{103}$ and $R_{104}$ may be respectively same or different.

Figure 12:
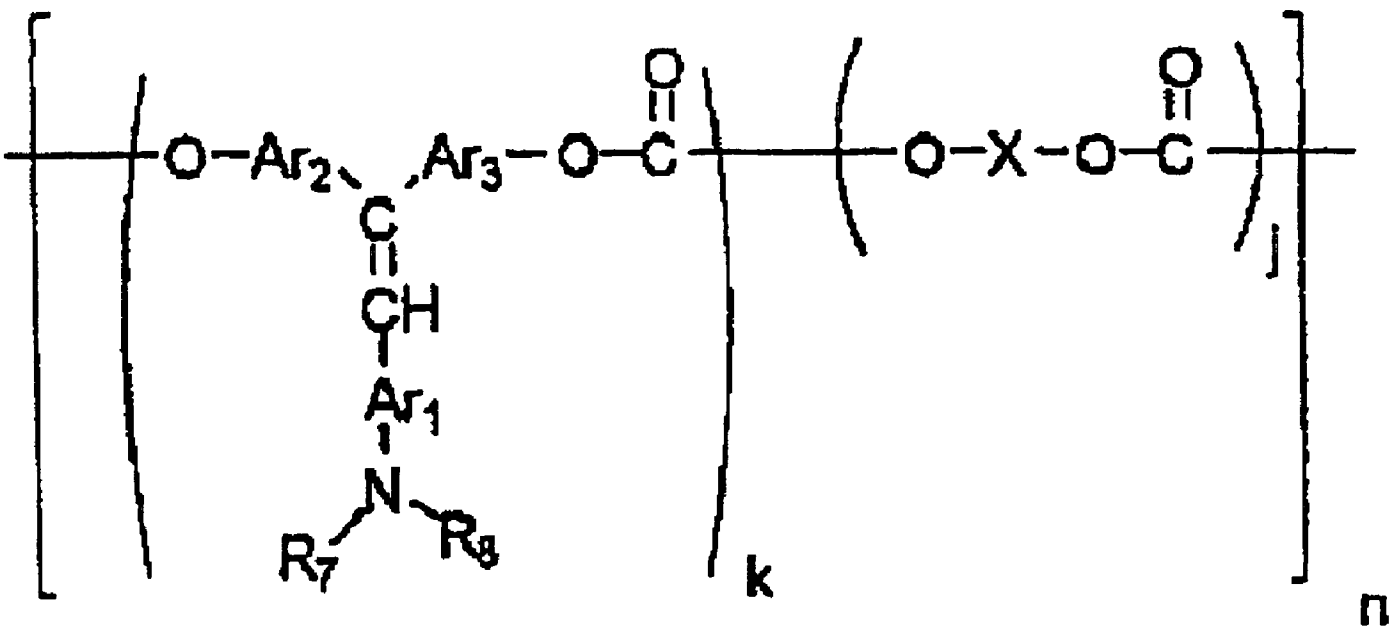

In formula (4) in FIG. 12, $R_7$ and $R_8$ are each substituted or unsubstituted aryl group; $Ar_1$, $Ar_2$ and $Ar_3$ are each same or different allylene groups. X, k, j and n are same as in the case of formula (1).

Figure 13:
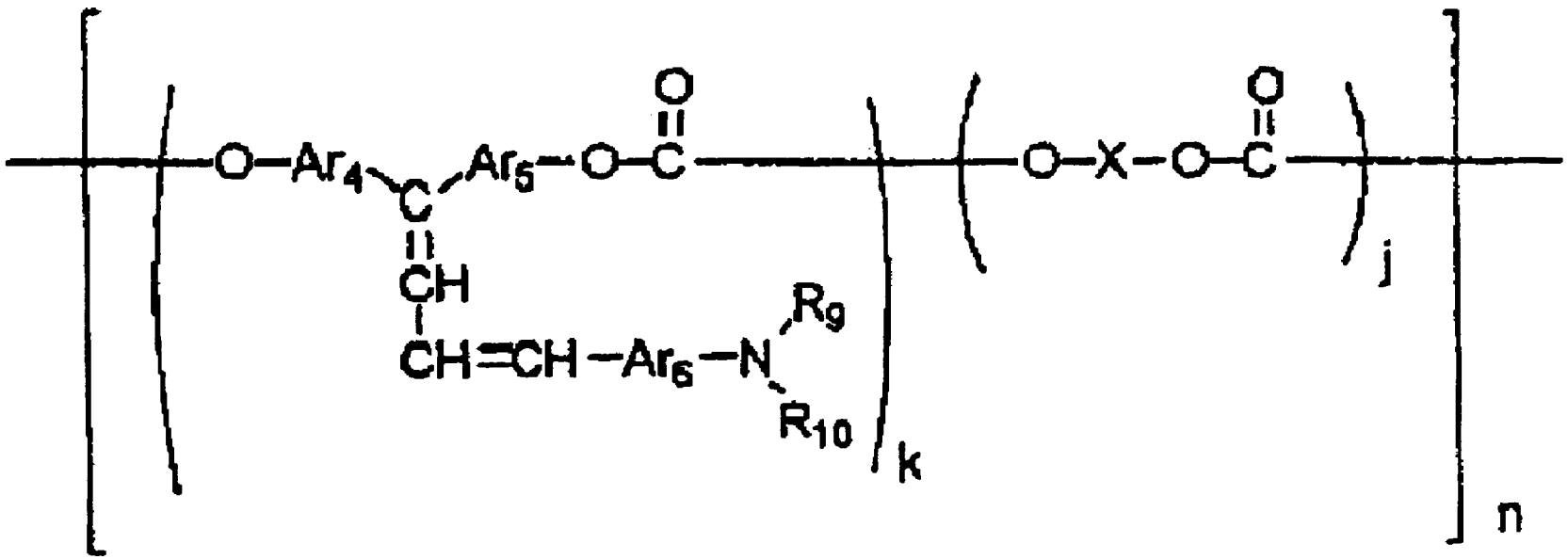

In formula (5) in FIG. 13, $R_9$ and $R_{10}$ are each substituted or unsubstituted aryl groups; $Ar_4$, $Ar_5$ and $Ar_6$ are same or different allylene groups. X, k, j and n are same as in the case of formula (1).

Figure 14:
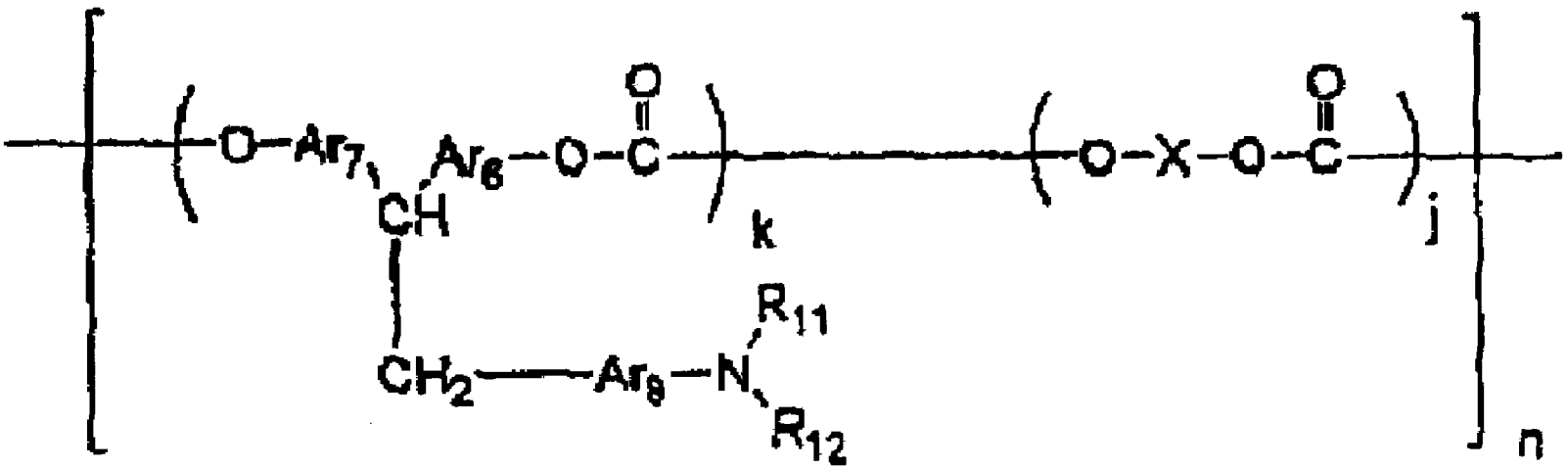

In formula (6) in FIG. 14, $R_{11}$ and $R_{12}$ are each substituted or unsubstituted aryl groups; $Ar_7$, $Ar_8$ and $Ar_9$ are each same or different allylene groups; p is an integer of 1-5. X, k, j and n are same as in the case of formula (1).

Figure 15:
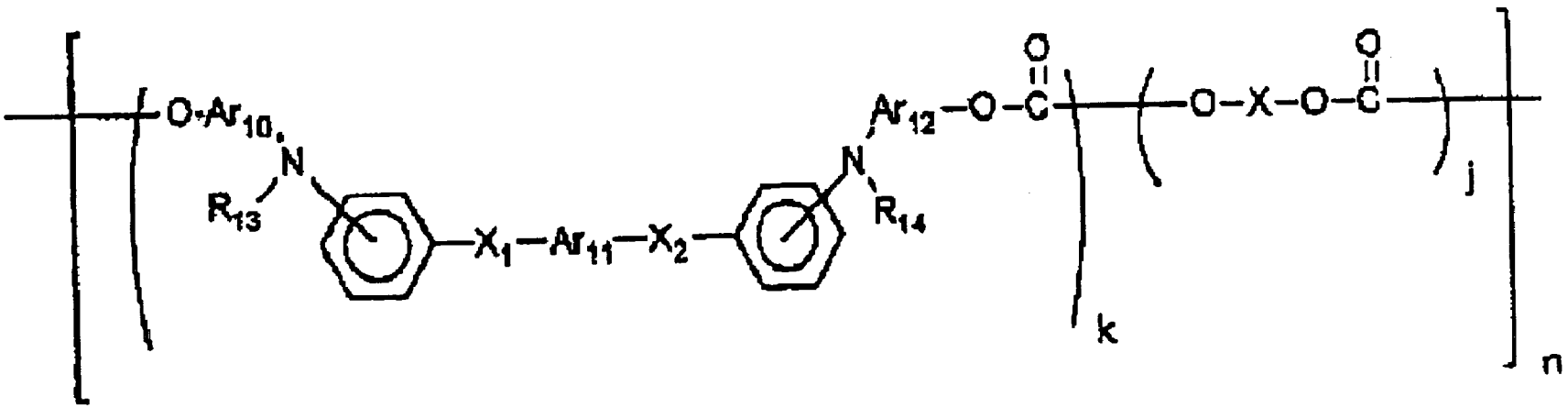

In formula (7) shown in FIG. 15, $R_{13}$, $R_{14}$ are each substituted or unsubstituted aryl groups; $Ar_{10}$, $Ar_{11}$, $Ar_{12}$ are each same or different allylene groups; $X_1$, $X_2$ are each substituted or unsubstituted ethylene groups, or substituted or unsubstituted vinylene groups. X, k, j and n are same as in the case of formula (1).

Figure 16:
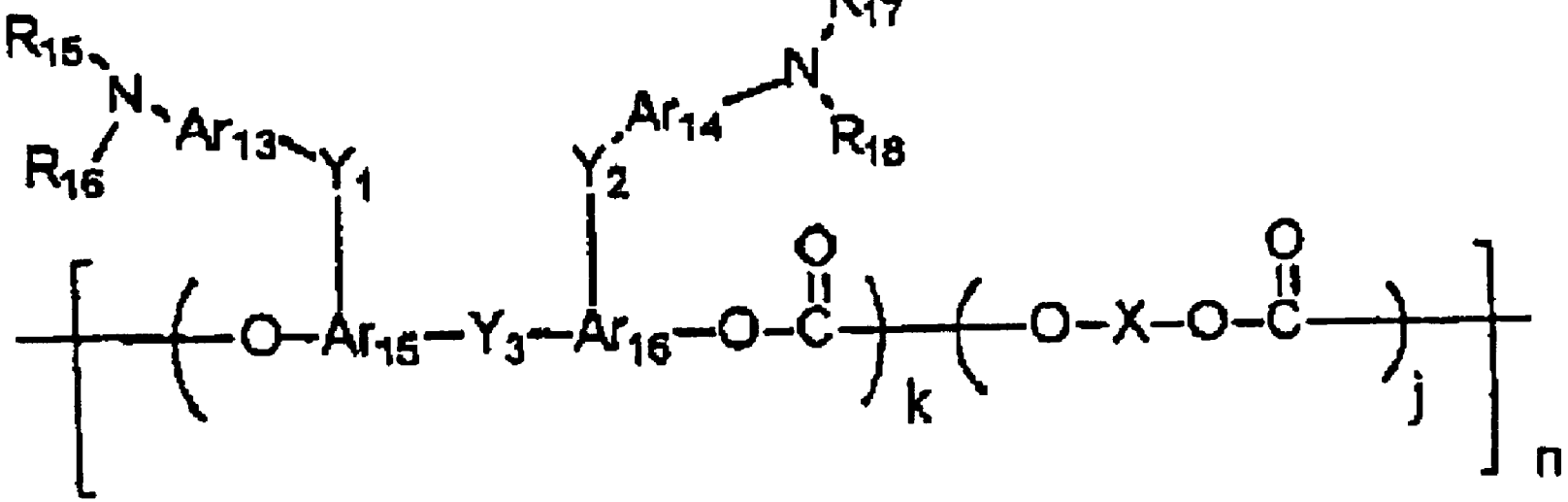

In formula (8) shown in FIG. 16, $R_{15}$, $R_{16}$, $R_{17}$ and $R_{18}$ are each substituted or unsubstituted aryl groups; $Ar_{13}$, $Ar_{14}$, $Ar_{15}$ and $Ar_{16}$ are same or different allylene groups; $Y_1$, $Y_2$ and $Y_3$ are each single bonding, substituted or unsubstituted alkylene groups, substituted or unsubstituted cycloalkylene groups, substituted or unsubstituted alkylene ether groups, oxygen atom, sulfur atom or vinylene groups, and they may be same or different. X, k, j and n are same as in the case of formula (1).

Figure 17:
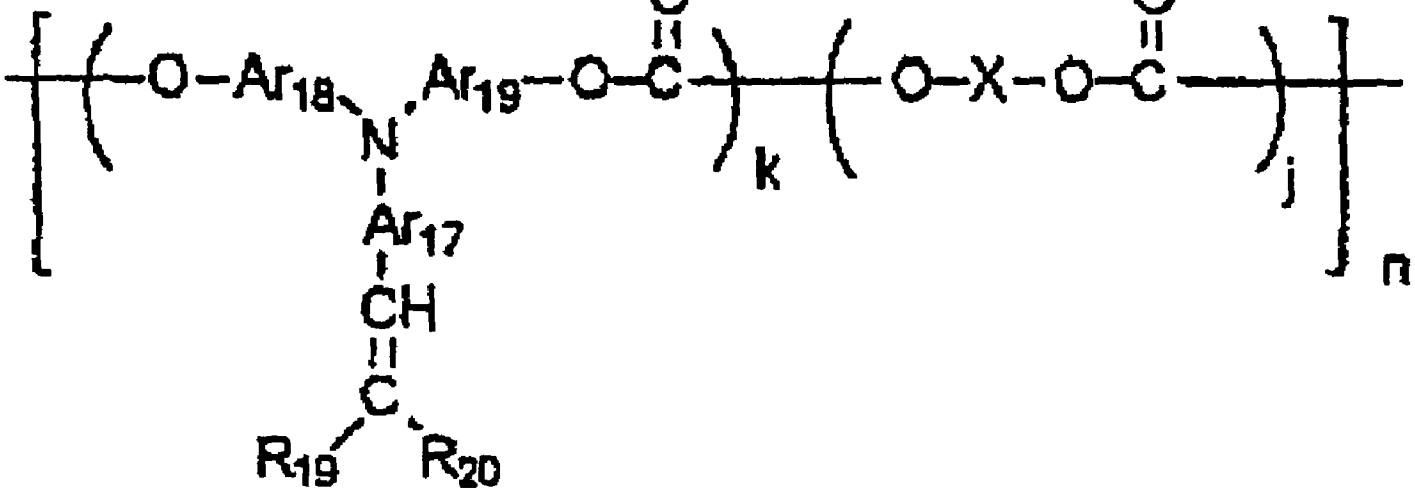

In formula (9) shown in FIG. 17, $R_{19}$ and $R_{20}$ are each hydrogen atom or substituted or unsubstituted aryl group, and $R_{19}$ and $R_{20}$ can form rings. $Ar_{17}$, $Ar_{18}$ and $Ar_{19}$ are same or different allylene groups. X, k, j and n are same as in the case of formula (1).

Figure 18:
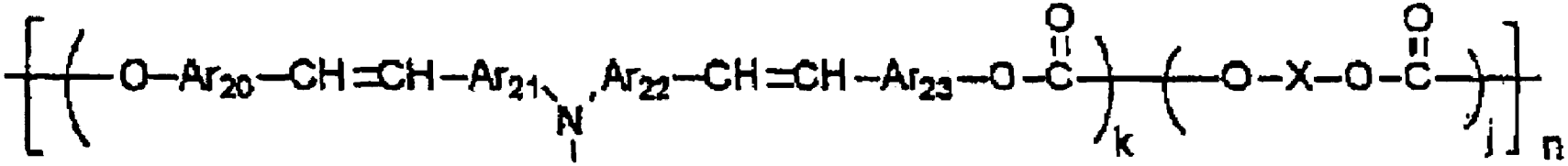

In formula (10) shown in FIG. 18, $R_{21}$ is a substituted or unsubstituted aryl group; $Ar_{20}$, $Ar_{21}$, $Ar_{22}$ and $Ar_{23}$ are same or different allylene groups. X, k, j and n are same as in the case of formula (1).

Figure 19:
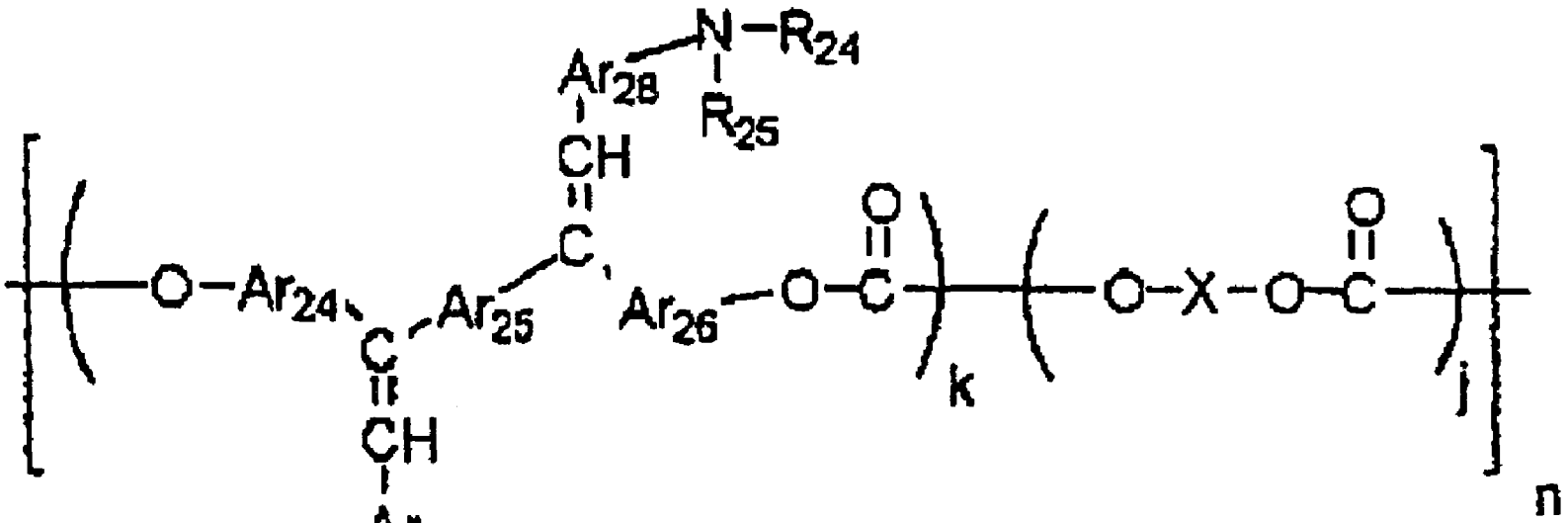

In formula (11) shown in FIG. 19, $R_{22}$, $R_{23}$, $R_{24}$ and $R_{25}$ are each substituted or unsubstituted aryl groups, $Ar_{24}$, $Ar_{25}$, $Ar_{26}$, $Ar_{27}$ and $Ar_{28}$ are same or different allylene groups. X, k, j and n are same as in the case of formula (1).

Figure 20:
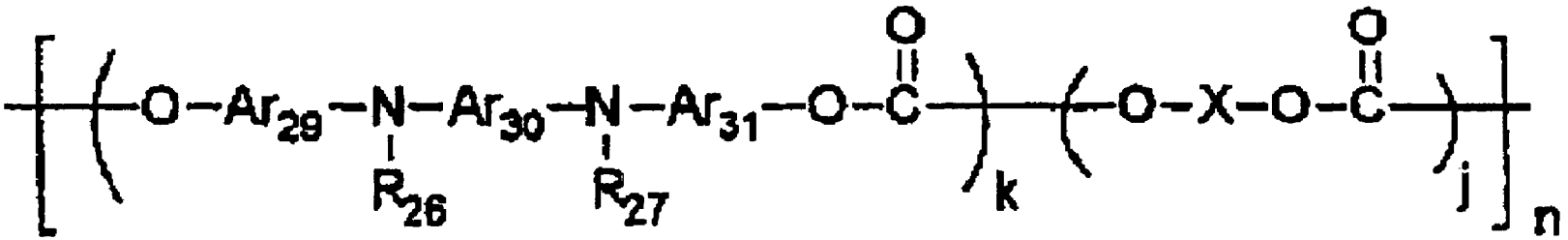

In formula (12) shown in FIG. 20, $R_{26}$ and $R_{27}$ are each substituted or unsubstituted aryl groups, $Ar_{29}$, $Ar_{30}$ and $Ar_{31}$ are same or different allylene groups. X, k, j and n are same as in the case of formula (1).

The filler contained in the protection layer 29 may be dispersed in a ball mill, sand mill, ultrasonic wave or similar conventional scheme together with at least an organic solvent and a dispersant. The dispersant should preferably be added from before dispersion together with the filler and organic solvent because the dispersant obstructs the cohesion of the filler in a coating liquid as well as sedimentation for thereby noticeably improving dispersibility. On the other hand, although the binder resin and charge transporting substance may be added before dispersion, they slightly lower dispersibility. It is therefore preferable to add the binder resin and charge transporting agent, dissolved in the organic solvent, after the dispersion.

While any one of conventional coating methods, including dip coating, spray coating, beat coating, nozzle coating and ring coating, is applicable to the coating liquid thus prepared, spray coating is most preferable because it can form a relatively thin, uniform layer in which the filler is uniformly dispersed.

A second embodiment of the present invention will be described hereinafter. Because the second embodiment is identical with the first embodiment as to appearance, reference will also be made to FIGS. 1 through 5. The second embodiment differs from the first embodiment in that the protection layer 29 is formed of at least one kind of crosslinking compound.

Considering electric stability, print resistance and life, the projection layer 29 should preferably be implemented as a layer formed of a charge transporting material having a compound-reactive group or a layer formed of a crosslinking compound. The charge transporting material with the reactive group may be any one of a compound in which a single molecule contains at last one charge transporting component and at least one silicon atom having a hydrolytic substituent, a compound in which a single molecule contains a charge transporting component and a hydroxyl group, a compound in which a single molecule contains a charge transporting component and a carboxyl group, a compound in which a single component contains a charge transporting component and an epoxy group, a compound in which a single molecule contains a charge transporting component and an isocyanate group and so forth. Among them, the compound in which a single molecule contains at least one charge transporting component and at least one silicon atom having a hydrolytic substituent is desirable from the print resistance standpoint. If desired, two or more of such charge transporting materials Containing a reactive group each may be used in combination.

As for the layer formed of a crosslinking compound, the crosslinking compound maybe anyone of a crosslinking, charge transporting compound containing nitrogen atoms in its structure, a silicone hard-coating material, thermosetting acrylic resin, thermosetting epoxy resin, thermosetting urethane resin and so forth. Among them, the charge transporting compound containing nitrogen atoms in the structure is desirable from the charge transport standpoint.

Figures 21, 22, 23:
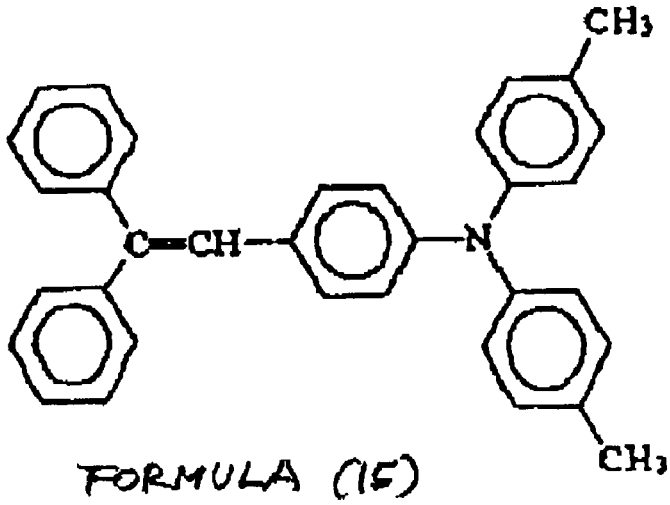

Further, in the illustrative embodiment, the "organic silicon compound containing a hydroxyl group.or a hydrolytic group or a condensate thereof" refers to siloxane resin having a tree-dimensional structure and produced by heat-curing one or more of organic silicone compounds each containing a hydroxyl group or a hydrolytic group and represented by a general formula (13) shown in FIG. 21 or condensates thereof. In the formula (13), R denotes an organic group in which carbon is directly coupled with a silicon atom, X denotes a hydroxyl group or a hydrolytic group, and n denotes an integer between 0 and 3. In this organic silica compound expressed by formula (13), as the organic group expressed by R in which carbon is directly bonded to silicon, alkyl groups such as methyl, ethyl, propyl and butyl, aryl groups such as phenyl, tryl, naphthyl and biphenyl, epoxy-containing groups such as γ-glycidoxy propyl, β-(3,4-epoxy-cyclohexyl)ethyl, (meth)acryloyl-containing groups such as γ-acryloxy propyl and γ-methacryloxy propyl, hydroxyl-containing group such as γ-hydroxy propyl and 2,3-dihydroxy propyloxy propyl, vinyl-containing group such as vinyl and propenyl, mercapto-containing group such as γ-mercaptopropyl, amino-containing group such as γ-aminopropyl and N-β(aminoethyl)-γ-aminopropyl, halogen-containing group such as γ-chloropropyl, 1,1,1-trifluoropropyl, nonafluorohexyl and perfluoro octylethyl, and other nitro-, cyano-substituted alkyl groups, are listed.

Particularly, alkyl groups such as methyl, ethyl, propyl and butyl are preferable. Alkoxy groups such as methoxy and ethoxy, halogen groups and acyloxy groups are listed for the hydrolysis group expressed by X. 6C or less alkoxy group is particularly preferable.

The organic silicon compound represented by the formula; (13) may be either one of a single compound or a combination of two or more compounds. To implement a crosslinking structure, it is preferable to use a single organic silicon compound whose n is 0 or 1.

When the compound represented by the formula (13) has n of 2 or above, a plurality of R's may be the same or different from each other. Likewise, when n is smaller than 2, a plurality of X's may be the same or different from each other Further, when two or more organic silicon compounds represented by the formula (13) are used, R's and X's of the compounds may be the same or different from each other.

As for the organic silicon compound, use may be made of a hydrolytic, oligomeric condensate produced by subjecting the compound to hydrolysis under the acid condition to the basic condition. Colloidal silica may be added to the organic silicon compound or a condensate thereof during or after the hydrolytic condensation of the organic silicon compound.

The "siloxane produced by the reaction of at least one of an organic silicon compound containing a hydroxyl group or an hydrolytic group and a condensate thereof and a charge transporting compound containing a reactive group" refers to siloxane resin produced when at least one of the above organic silicon compound and condensate thereof and a charge transporting compound, containing a reactive group to be described later, react with each other. The resulting siloxane resin structure with a crosslinking structure includes a structure unit having. a charge transporting ability as a partial structure.

The charge transport substance having the chemical structure of chemical formula (14) as a general formula shown in FIG. 22, is a typical one as the charge transport compound having are active group. Any compound can be used which has a reactive group reacting with a hydroxyl group of the organic silicon compound or colloidal silica, and shows a property of having drift moving property of electrons or holes, and not limited to the following chemical structure:

In formula (14), A is a charge transporting compound group; Z is a group selected from hydroxyl group, mercapto group, amino group and organic silica-containing group; m is an integer of 1-4. As the charge transporting compound expressed by A of the hole transporting type, includes compound groups and their derivative compound groups containing structure units, such as, xyazole, oxadiazole, thiazole, triazole, imidazole, imidazolone, imidazoline, bis-imidazolidine, hydrazone, bebzidine, pyrazoline, triarylamine, oxyazolone, benzothiazole, benzoimidazole, quinazoline, acridine or phenadine.

The "siloxane-based resin obtained by reacting at least either one of an organic silicon compound having a hydroxyl group or hydrolyzable group and its condensate, with a charge transporting compound having a reactive group" in the present implement, can form a three-dimensional network structure by adding a catalyst or a cross-linking agent to a monomer, oligomer or polymer having a siloxane bondingin the structure unit in advance. It can also form the three-dimensional network structure from a monomer, oligomer or polymer, by promoting, the siloxane bonding by a hydrolysis reaction and dehydration condensation thereafter.

In general, a condensation reaction of a composition having alkoxysilane or a composition having alkoxysilane and colloidal silica can form the three-dimensional network structure.

The catalyst for forming the three-dimensional network structure includes: alkaline metallic salts of organic carboxylic acid, nitrous acid, sulfurous acid, aluminic acid, carbonic acid and thiocyanate, organic amine salts (tetramethyl ammonium hydroxide, tetramethyl ammonium acetate), tin organic acid salts (stannus octate, dibutyltindiacetate, dibutyltindilaulate, dibutyltinmercaptide, dibutyltinthiocarboxylate, dibutyltin maliate, etc.), aluminum, zinc octate, naphthenate, and acetylacetone complex compounds.

An antioxidant having hindered phenol, hindered amine, thioether or phosphite part structure can be added to the resin layer of the present embodiment, to be effective for improvement of the potential stability and image quality in the environmental variation.

A third embodiment of the present invention will be described hereinafter. Because the third embodiment is identical with the first embodiment as to appearance, reference will also be made to FIGS. 1 through 5. The third embodiment differs from the first embodiment in that the surface layer of the drum 13, corresponding to the protection layer 29 of the first embodiment, is implemented as a charge injection layer whose volmetric resistance is between $1\times10^{8}$ Ω·cm and $1\times10^{14}$ Ω·cm.

The volmetric resistance of the charge injection layer should preferable be between $1\times10^{8}$ Ω·cm to $1\times10^{15}$ Ω·cm for implementing sufficient chargeability and reducing image running. More preferably, the volmetric resistance should be between $1\times10^{10}$ Ω·cm and $1\times10^{14}$ Ω·cm from the image running standpoint. If the volmetric resistance is less than $1\times10^{8}$ Ω·cm, then an image is apt to run because charges cannot not be retained in the direction of surrace in a humid environment. If the volmetric resistance is higher than $1\times10^{15}$ Ω·cm, then charges cannot be sufficiently injected from a charging member, resulting in detective charging.

In the illustrative embodiment, to measure the volmetric resistance of the charge injection layer, a surface layer is formed on a PET (polyethylene terephthalate) film on which gold is deposited by evaporation. A volmetric resistance measuring device 414B pA MATER (trade name) available from Hewlett Packard is used for the measurement with a voltage of 100 V being applied to the PET film in a 23° C., 65% humidity environment.

The charge injection layer thus formed on the drum 13 serves to retain charges injected from a charging member and further serves to release the charges to the base 27 during exposure for thereby lowering residual potential.

The charge injection layer is implemented as, e.g., a metal evaporation layer or similar inorganic layer or a resin layer in which conductive fine grains are dispersed in binder resin. The evaporation layer is formed by evaporation while the above resin layer is formed by any one of dip coating, spray coating, roll coating, beam coating and other conventional technologies. Alternatively, the evaporation layer may be formed by mixing or copolymerizing light-transmitting resin having high ion conductivity with insulative binder resin or by using single photoconductive resin having medium resistance. It is preferable to disperse conductive grains in insulating resin for thereby adjusting resistance.

Because the medium resistance layer is formed on the photoconductive layer, it is not desirable to make the charge injection layer excessively thick. However, if the charge infection layer is worn out, then charge injection does not occur, resulting in defective charging. In light of this, the charge injection layer should be relatively thin and mechanically strong. more specifically, the charge injection layer should preferably be 1 μm to 1 μm thick.

As the conductive particles to be used for the present implement, one or two or more types of superfine particles of zinc oxide, titanium oxide, tin oxide, antimony oxide, indium oxide, indium oxide doped with tin, tin oxide doped with antimony and zirconium oxide, can be used.

As the binder resin for dispersing these conductive particles, general insulating resins can be used, however, from the point of the film strength as mentioned above, a monomer having a reactive functional group, such as acrylic resin, urethane resin or silicone resin, or a curing type resin crosslinking with heat or light when film forming an oligomer, is preferable. The weight ratio of the conductive particles to the binder resin is suitably between 5/10 and 10/2. An additive such as a lubricity imparting agent and a plasticizer can be added to it.

Among them, a photosetting or thermosetting acrylic resin is preferably used from the points of dispersiveness of the conductive particles and the mechanical strength as the transporting layer.

The charge injection layer can contain, when necessary, an additive, such as a plasticizer such as, biphenyl, biphenyl chloride, terphenyl, dibutylphthalate, diethyleneglycol phthalate, dioctyl phthalate, triphenyl phosphate, methylnaphthalene, benzophenone, paraffin chloride, polypropylene, polystyrene, various fluorohydrocarbons, a surface reforming agent such as silicone oil, an antioxidant such as phenol-based, sulfur-based, phosphorus-based and amine-based compounds, an anti-photodegradation agent, such as benzotriazole-based compound, benzophenone based compound and hindered amine-based compound.

The charge injection layer can be formed by coating the coating liquid prepared by dissolving or dispersing the above listed materials in an organic solvent to form the film. The organic solvent differs depending on the type of the material to be used, and the optimal one is suitably selected. Following organic solvents are preferable: alcohols such as methanol, ethanol or n-propanol; ketones such as acetone, methyl ethyl ketone or cyclohexanone; amides such as N,N-dimethylformamide or N,N-dimethylacetamide; ethers such as tetrahydrofuran, dioxane or methyl cellosolve; esters such as methyl acetate or ethyl acetate; sulfoxides and sulfons such as dimethyl sulfoxide or sulfolane; aliphatic hydrocarbon halides such as methylene chloride, chloroform, carbon tetrachloride or trichlorothane: aromatics such as benzene, toluene, xylene, monochlorobenzene or dichlorobenzene. Among them, alcohols such as methanol, ethanol or n-propanol; ethers such as dibutyl ether; and hydrocarbons such as hexane or Isoper, are preferable from the points of little solubility of the photoconductive layer 28 in them.

As the coating method of the coating liquid prepared by dissolving or dispersing the above-listed materials in the organic solvent, the general coating method such as blade coating method, wirebar coating method, spray coating method, dipping coating method, bead coating method, air knife coating method and curtain coating method can be used.

As for the charging member for charging the drum 13 provided with the charge injection layer, use may be made of a scorotron charger or similar corona charger or a charge roller. However, a magnet brush is desirable because it can closely contact the charge injection layer and can collect toner left on the drum 13 after image transfer without resorting to the conventional cleaning or similar substantial cleaning means, implementing so-called cleanerless collection.

For magnetic grains that form the magnet brush, use may be made of grains produced by kneading resin and magnetite or similar magnetic material with or without, e.g., conductive carbon mixed for resistance adjustment, grains of sintered magnetite or ferrite subjected or not subjected to reduction or resin coating for resistance adjustment or such grains plated for resistance adjustment. The resistance of the magnetic grains should preferably be between $10^4$ μ·cm and $10^7$ μ·cm. If the resistance is less than $10^4$ μ·cm, then the leak of the drum 13 or the adhesion of the magnetic grains to the drum 13 is apt to occur. If the resistance is higher than $10^7$ μ·cm, then sufficient charge injection is not attainable, resulting in defective charging. To configure the magnetic grains as a magnet brush or charging member, the magnetic grains are magnetically retained on a magnet roller or a nonmagnetic, conductive sleeve accommodating a magnet roller thereon.

The magnet brush thus produced is held in contact with the drum 13 and rotated, as needed. While the magnet brush may be rotated in the same direction or the opposite direction to the drum 13, as seen at the point of contact, the opposite direction is advantageous in that it increases the probability of contact because of a difference in. peripheral speed.

In the present implement, an intermediate layer can be provided between the photoconductive layer 28 and the charge injection layer, for the purposes of protecting the photoconductive layer 28 from the solvent when coating the charge injection layer, improving the adhesiveness of the charge injection layer with the photoconductive layer 28, and preventing the lowering of the charged potential due to the injected charge by staying,the injected charge between the charge injection layer and the layer 28.

As the materials of the intermediate layer, following substances can be listed from the above points: various organic high polymers such as, epoxy resin, polyester resin, polyamide resin, polystyrene resin, polyvinylidene chloride, polyvinyl acetate, polyvinyl chloride, acrylic resin, silicone resin, or fluorine resin; silane coupling agents such as, trimethyl monomethoxysilane, γ-glycidoxypropyl trimethoxysilane, or γ-methacryloxypropyl trimethoxysilane; metallic alkoxides such as titanium tertrabutoxide, aluminum tripropoxide, or zirconium tetrabutoxide; high polymer compounds formed of one of or combination of two or more types of metallic acetylacetonate complexes such as, titanium acetylacetonate, or zirconium acetylacetonate. The thickness of the intermediate layer is normally 10 μm or below, preferably 0.1 μm to 1.0 μm.

Figure 6:
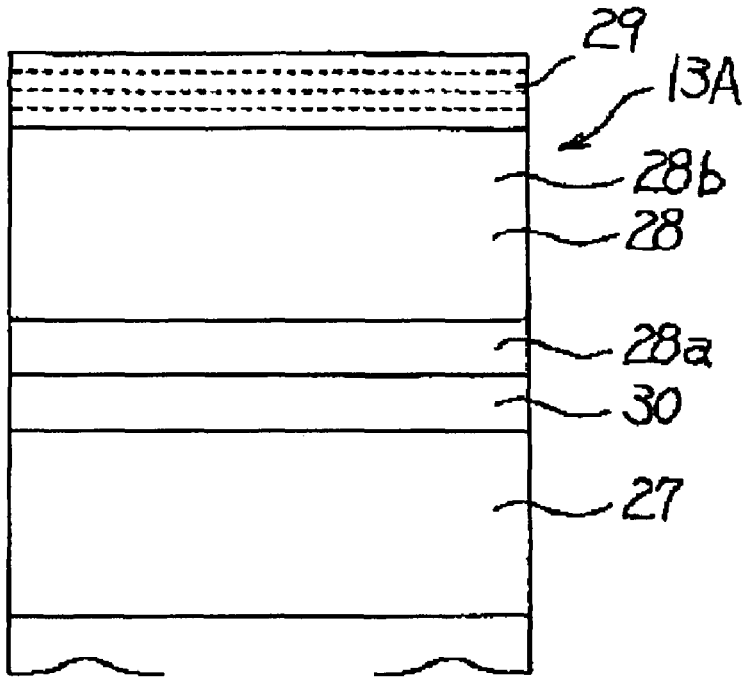
FIG. 6 is a section showing the structure of a photoconductive drum representative of a fourth embodiment of the present invention.

Reference will be made to FIG. 6 for describing a fourth embodiment of the present invention. In FIG. 6, structural elements identical with those of the first embodiment are designated by identical reference numerals and will not be described in order to avoid redundancy. As shown, the illustrative embodiment includes a photoconductive drum 13A instead of the drum 13. The drum 13A differs from the drum 13 in that an under layer 30 is formed between the conductive support 27 and the charge generating layer 28*a*. The under layer 30 serves to conceal the surface roughness, undulation and other defects of the support 27, obviate moiré, insure adhesion of the support 27 and charge generating layer 28*a*, block carrier injection from the support 27 for thereby stabilizing potential, and prevent residual potential from rising.

The undercoat layer 30 has in general a resin as the principal component. Considering that these resins are coated on the surface with the charge generating layer 28*a* using a solvent, resins with high solvent-resistant property are preferable. For such a resin, a water soluble resin such as, polyvinyl alcohol, polyvinyl butyral, casein, or sodium polyacrylate; an alcohol soluble resin such as, copolymer nylon, or methoxymethylated nylon; curable resins forming three-dimensional network structure such as, polyurethane, melamine resin, phenol resin, alkyd-melamine resin, epoxy resin, are listed. To the undercoat layer 30, fine powder pigment of a metallic oxide represented by titanium oxide, silica, alumina, zirconium oxide, tin oxide or indium oxide, can be added for preventing moire, or reducing the residual potential. These undercoat layers 30 can be formed by using a proper solvent and a coating method, like the above-mentioned photoconductive layer 28 (the charge generating layer 28*a*, charge transporting layer 28*b*). As the undercoat layer 30 of the present invention, a silane coupling agent, titanium coupling agent, or chromium coupling agent can be used. Various types of dispersant can also be added. The undercoat layer 30 provided with $Al_2O_3$ by anodic oxidation, or with an organic substance such as polyparaxylene (parylene) or an inorganic substance such as $SiO_2$, $SnO_2$, $TiO_2$, ITO, or $CeO_2$ by vacuum thin film forming method, can also be satisfactorily used. Other known substances can be used for the present invention. The thickness of the undercoat layer 30 is suitably 1-5 μm.

Figure 7:
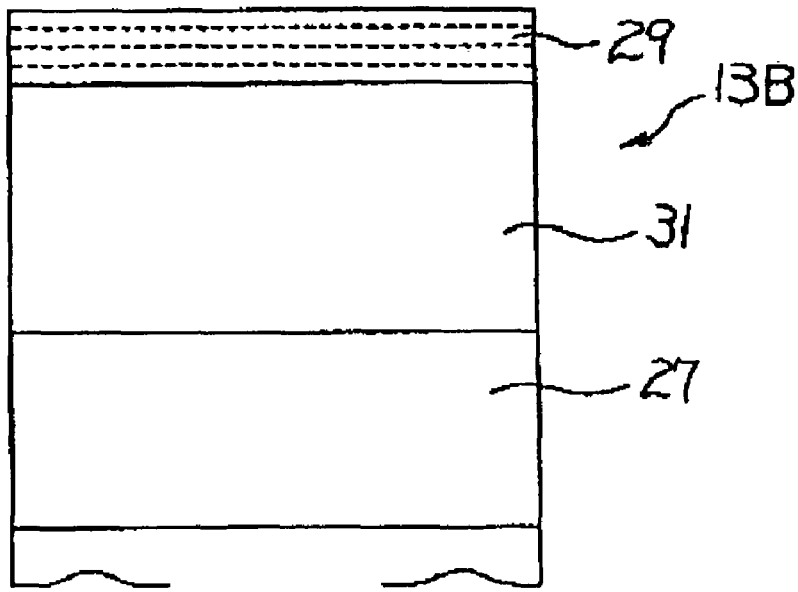
FIG. 7 is a section showing the structure of a photoconductive drum representative of a fifth embodiment of the present invention.

FIG. 7 shows a fifth embodiment of the present invention identical with the first embodiment except that a photoconductive drum 13B is substituted for the drum 13. The drum 13B is made up of the tubular conductive base 27, a photoconductive layer 31 formed on the outer periphery of the base 27, and the protection layer or surface layer 29 formed on the outer periphery of the photoconductive layer 31.

The photoconductive layer 31 is a single layer formed by dissolving or dispersing a charge generating substance, a charge transporting substance and binder resin in a suitable solvent and coating and then drying the resulting mixture. A plasticizer, a leveling agent, an antioxidant, a lubricant and other additives may be added, as needed. For the charge generating substance and charge transporting substance, the materials described in relation to the charge generating layer 28*a* and charge transporting layer 28*b* of the first embodiment maybe used. As for the binder resin, not only the binder resin described in relation to the charge transporting layer 28*b* but also the binder resin described in relation to the charge generating layer 28*a* may be used. Of course, a high molecular, charge transporting layer to be described later may advantageously be used.

The photoconductive layer 31 preferably contains 5 parts by weight to 40 parts by weight of the charge generating substance for 100 parts by weight of the binder resin, and the amount of the charge transport substance is preferably 1 parts by weight to 190 parts by weight, more preferably, 50 parts by weight to 150 parts by weight. The photoconductive layer 31 can be formed by coating the coating liquid prepared by dispersing the charge generating substance and binder resin, together with the charge transport substance using a solvent such as, tetrahydrofuran, dioxane, dioxolane, dichloroethane, or cyclohexane, using the dipping method, spray coating, bead coating or ring coating, then drying. The thickness of the photoconductive layer 31 is preferably 5 μm to 25 μm.

Figure 8:
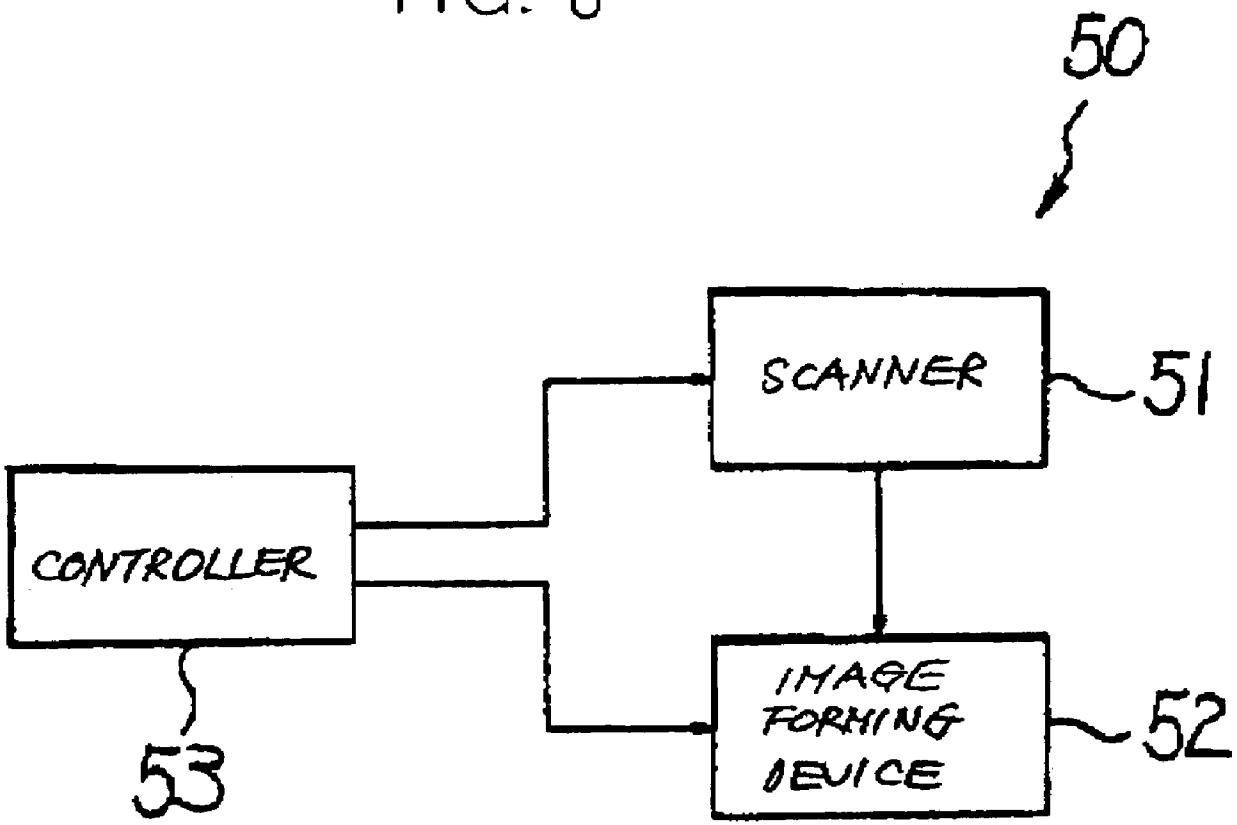
FIG. 8 is a schematic block diagram showing an image forming apparatus representative of a sixth embodiment of the present invention.

FIG. 8 shows a copier 50 representative of a sixth embodiment of the present invention. As shown, the copier 50 includes a scanner 51 for reading a document, an image forming apparatus 52 described in relation to any one of the first to fifth embodiments, and a controller 53 for controlling the scanner 51 and image forming apparatus 51 to form an image in accordance with image data read by the scanner 51. The copier 50 therefore achieves the same advantages as the first to fifth embodiments.

Specific examples of the present invention will be described hereinafter. In the specific examples, photoconductive drums different in structure were produced and mounted to an image forming apparatus not including the air conditioning means 11 and an image forming apparatus including it in order to examine the quality of resulting images and the wear of the surface of each drum. It is to be noted that a term "part" to repeatedly appear in the following description refers to part by weight.

<Drum 1>

On an aluminum cylinder with a diameter of 30 mm, the undercoat layer coating liquid, the charge generating layer coating liquid and the charge transporting layer coating liquid were coated in this order by the dipping coating method, followed by drying, to form about 3.5 μm thick undercoat layer, about 0.2 μm thick charge generating layer and about 15 μm thick charge transporting layer with the following compositions, respectively:

| Undercoat Layer Coating Liquid | |
|---|---|
| titanium oxide powder: | 400 parts |
| melamine resin: | 65 parts |
| alkyd resin: | 120 parts |
| 2-butanone: | 400 parts |

-continued

| Charge Generating Layer Coating Liquid | |
|---|---|
| Type Y oxo-titanium phthalocyanine pigment: | 2 parts |
| polyvinyl butyral (Eslex BM-1, a product of Sekisui Chemical Co.); | 1 part |
| tetrahydrofuran: | 50 parts |
| The charge transporting layer coating liquid | 12 parts |
| polycarbobate (Z polyca, a product of Teijin Co.); | |
| tetrahydrofuran: | 100 parts |
| the charge transport substance of chemical formula (15) shown in FIG. 23: | 8 parts |
| Spray coating was further repeatedly applied to the above charge transporting layer using the protection layer coating liquid of the following composition, to form a protection layer with about 5 μm of the total thickness, forming the photoconductive layer 1. | |
| Protection Layer Coating Liquid | |
| alumina (average primary particle size: 0.3 μm, a product of Sumitomo Chemical Industry Co.) | 0.3 part |
| unsaturated polycarboxylic acid polymer (acid value 180 mg KOH/g, a product of BYK Chemie Co.) | 0.08 part |
| charge transport substance expressed by constitutional formula (15): | 4 parts |
| polycarbonate (Z polica, a product of Teijin Co.); | 6 parts |
| tetrahydrofurane: | 230 parts |
| cyclohexanone: | 70 parts |

<Drum 2>

A drum 2 was identical with the drum 1 except that the amount of alumina contained in the protection layer coating liquid was 0.7 part.

<Drum 3>

A drum 3 was identical with the drum 1 except that the amount of alumina contained in the protection layer coating liquid was 1.1 parts.

<Drum 4>

A drum 4 was identical with the drum 1 except that the amount of alumina contained in the protection layer coating liquid was 1.5 parts.

<Drum 5S>

A drum 5 was identical with the drum 1 except that the amount of alumina contained in the protection layer coating liquid was 2.5 parts.

<Drum 6>

A drum 6 was identical with the drum 1 except that the amount of alumina contained in the protection layer coating liquid was 4.3 parts.

<Drum 7>

A drum 7 was identical with the drum 1 except that the amount of alumina contained in the protection layer coating liquid was 6.7 parts.

<Drum 8>

A drum 8 was identical with the drum 1 except that the amount of alumina contained in the protection layer coating liquid was 0 part.

<Drum 9>

Figure 24:
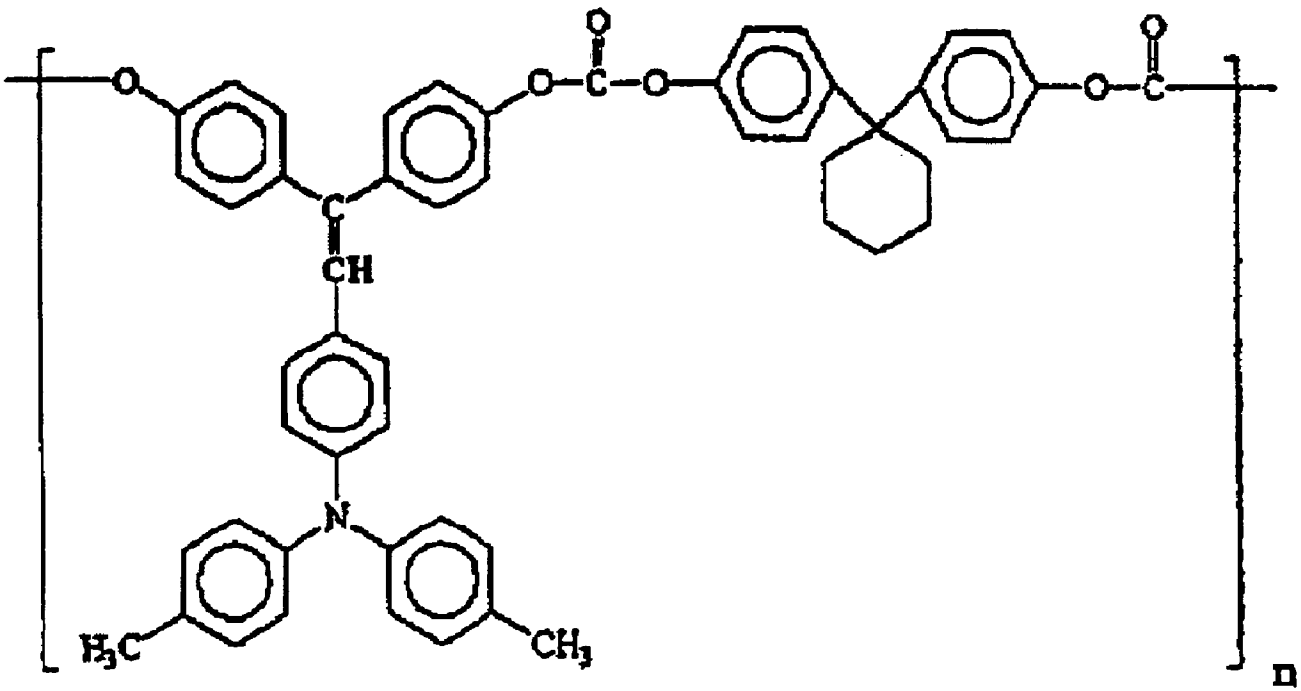

A drum 9 was identical with the drum 1 except that the protection layer coating liquid had the following composition:

| Protection Layer Coating Liquid | |
|---|---|
| alumina (average primary particle size: 0.3 μm, a product of Sumitomo Chemical Industry Co.): | 2.5 parts |
| unsaturated polycarboxylic acid polymer (acid value 180 mg KOH/g, a product of BYK Chemie Co.): | 0.8 part |
| tetrahydrofuran: | 230 parts |
| cyclohexanone: | 70 parts |
| high polymer charge transfer substance expressed by formula (16) shown in FIG. 24: | 10 parts |

<Drum 10>

A drum 10 was identical with the drum 1 except for the protection layer coating liquid.

Figure 25:
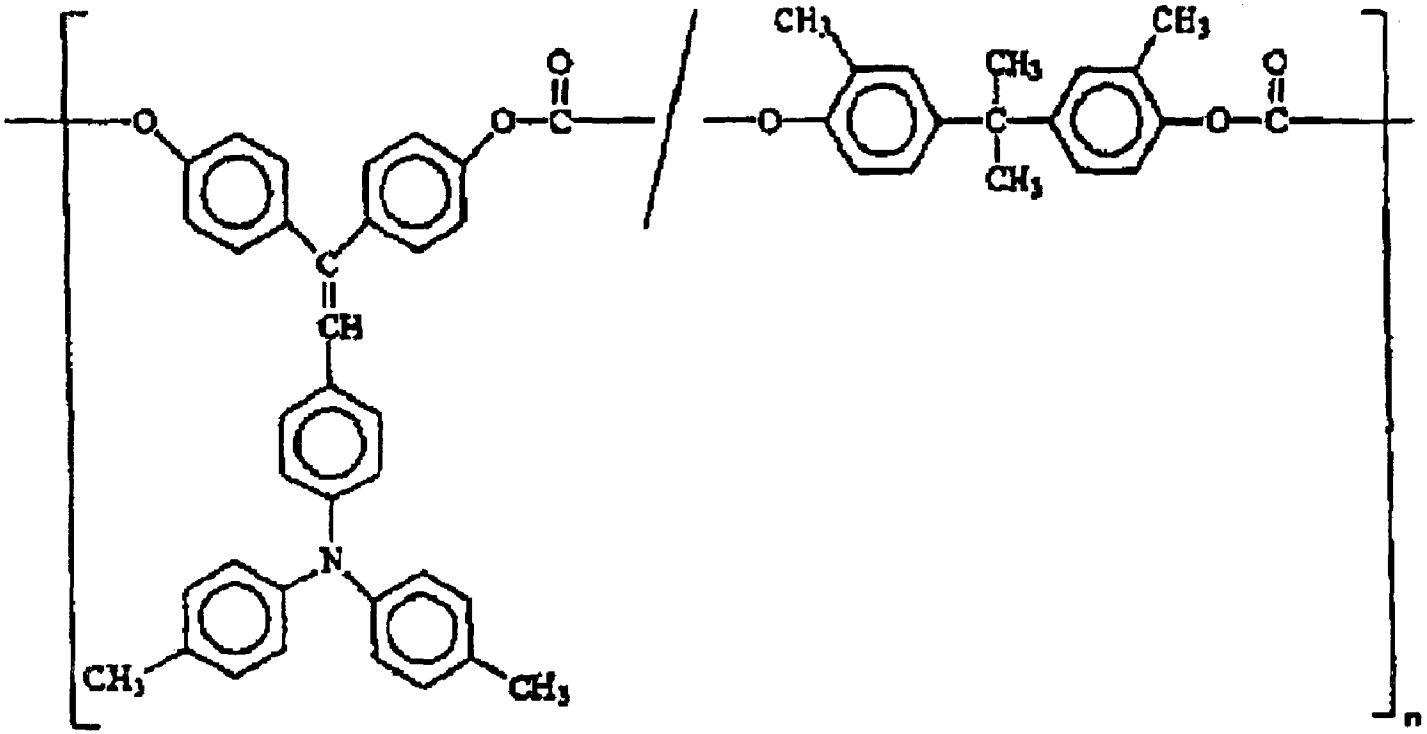

| Protection Layer Coating Liquid | |
|---|---|
| alumina (average primary particle size: 0.3 μm, a product of Sumitomo Chemical Industry Co..): | 2.5 parts |
| unsaturated polycarboxylic acid polymer (acid value 180 mg/KOH, a product of BYK Chemie Co.): | 0.08 part |
| high polymer charge transfer substance of formula (17) shown in FIG. 25: | 10 parts |

<Drum 11>

Figure 26:
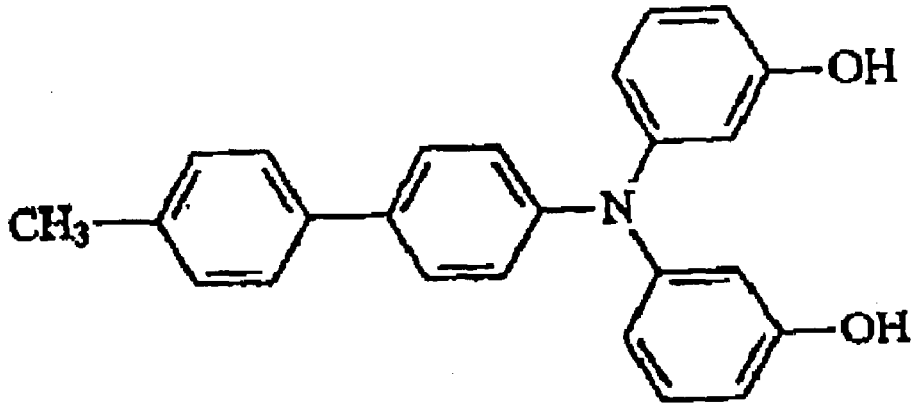
Figure 27:
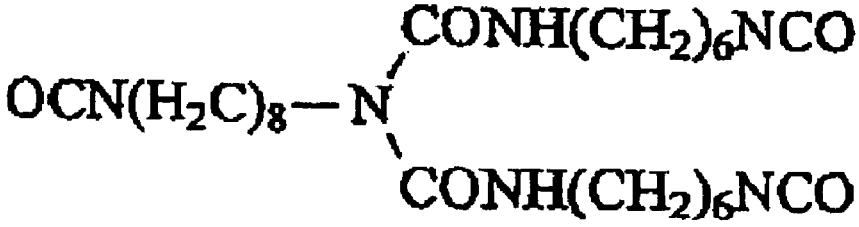

A drum 11 was identical with the drum 1 except for the protection layer coating liquid and protection layer forming method. To prepare a protection layer coating liquid, 1 part of a compound represented by a formula (18) shown in FIG. 26 and 2 parts of a modified bullet solution (67% of solid) were dissolved in 50 parts of cyclohexane. The coating liquid was spray-coated on the charge transporting layer, dried for 10 minutes at room temperature and then heated for 60 minutes at 150° C. to thereby form a 4 μm thick protection layer.

<Drum 12>

A drum 12 was identical with the drum 1 except for the protection layer coating liquid and thickness and forming conditions.

Protection Layer Coating Liquid

The coating liquid for the protection layer was prepared by mixing 182 parts of methyltrimethoxysilane, 40 parts of dihydroxy methyltriphenylamine, 225 parts of 2-propanol, 106 parts of 2% acetic acid, and 1 part of aluminum trisacetylacetonate.

This coating liquid was coated on the charge transporting layer and dried, followed by heating curing at 110° C. for one hour to form the 3 μm thick protection layer, <Drum 13>

A drum 13 was identical with the drum except for the protection layer coating liquid, film thickness and manufacturing conditions.

Protection Layer Coating Liquid

The coating liquid for the protection layer was prepared by mixing 182 parts of methyltrimethoxysilane, 40 parts of dihydroxy methyltriphenylamine, 225 parts of 2-propanol, 106 parts of colloidal silica (30% methanol solution) 106 parts of 2% acetic acid, 1 part of aluminum trisacetylacetnate.

This coating layer was coated on the charge transporting layer, followed by heating curing at 110° C. for one hour to form the 3 μm thick protection layer.

<Drum 14>

A drum 14 was identical with the drum 1 except for the protection layer coating liquid, film thickness and manufacturing conditions.

Protection Layer Coating Liquid

The coating liquid for the protection layer was prepared by mixing 150 parts of methyltrimethoxysilane, 30 parts of phenyltrimethoxysilane 75 parts of dihydroxy methyltriphenylamine, 225 parts of 2-propanol, 106 parts of 2% acetic acid, 106 parts of colloidal silica (30% methanol solution), 4 parts of aluminum triacetylacetnate.

The coating liquid was coated on the charge transporting layer and then heat-cured for 1 hour at 110° C. to thereby form a 3 μm thick protection layer.

<Drum 15>

A drum 15 was identical with the drum 1 except for the protection layer coating liquid, layer thickness and forming conditions.

Protection Layer Coating Liquid

Figure 28:
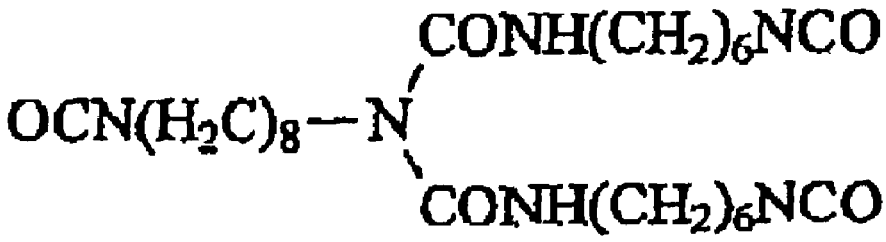
Figure 29:
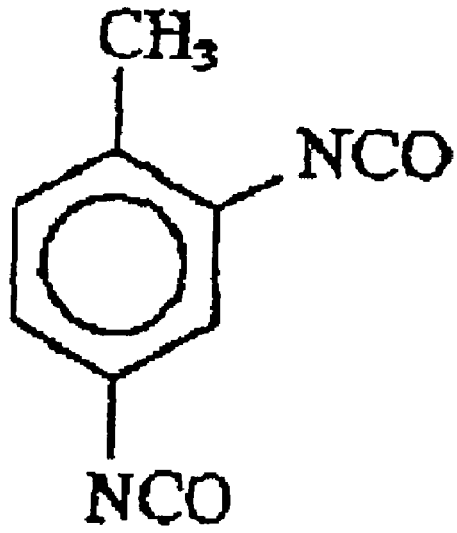

The coating liquid for the protective was prepared by adding 4 parts of powder of, tin oxide with 0.5 μm average particle size and 1.4 parts of Retan thinner (a product of Kansai Paint Co.), mixing and dispersing using a ball mill for 25 hours, then adding 14 parts of Retan thinner and 1 part of a Retan curing agent (burette type hexamethylenediisocyanate, expressed in formula (20) shown in FIG. 28.

The coating liquid was spray-coated on the charge transporting layer and then dried for 4 hours at 130° C. to thereby form a 5 μm thick protection layer. Functioning as a charge injection layer, the protection layer had volmetric resistance of $3\times10^{13}$ Ω·cm in a 23° C., 65% humidity environment.

<Drum 16>

A drum 16 was identical with the drum 15 except that 1.5 parts of an atactic hardener was used to cure polyurethane. Functioning as a charge injection layer, the protection layer had volmetric resistance of $3.5\times10^{13}$ Ω·cm in a 23° C., 65% humidity environment.

<Drum 17>

Figure 30:
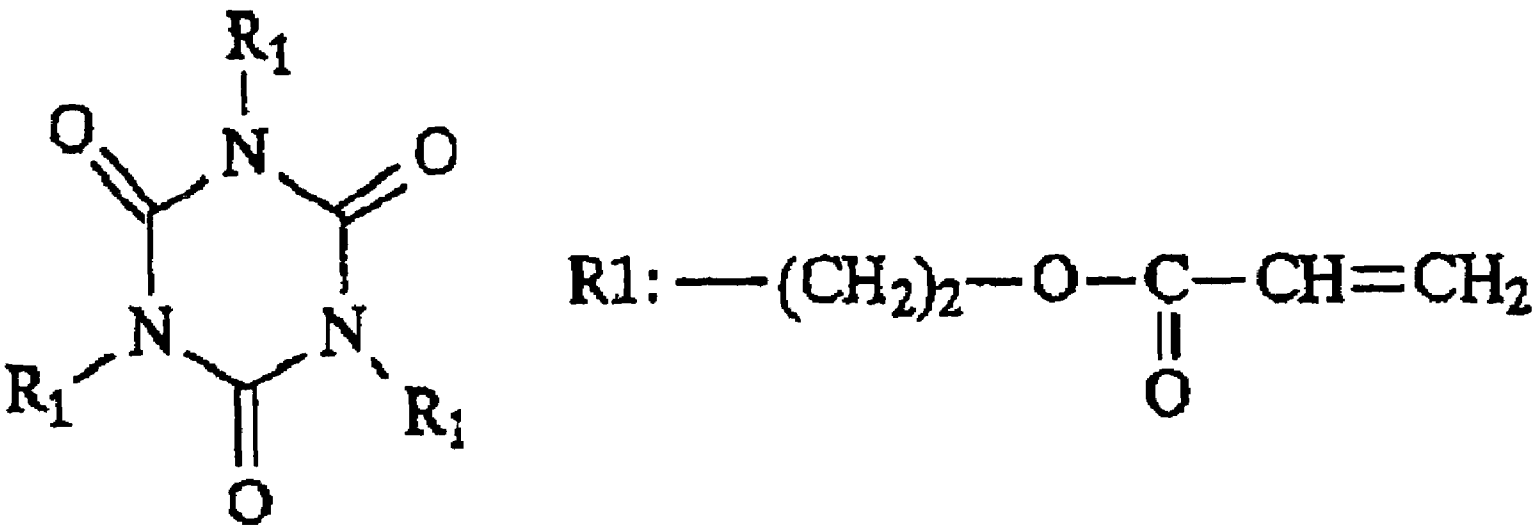
Figure 31:
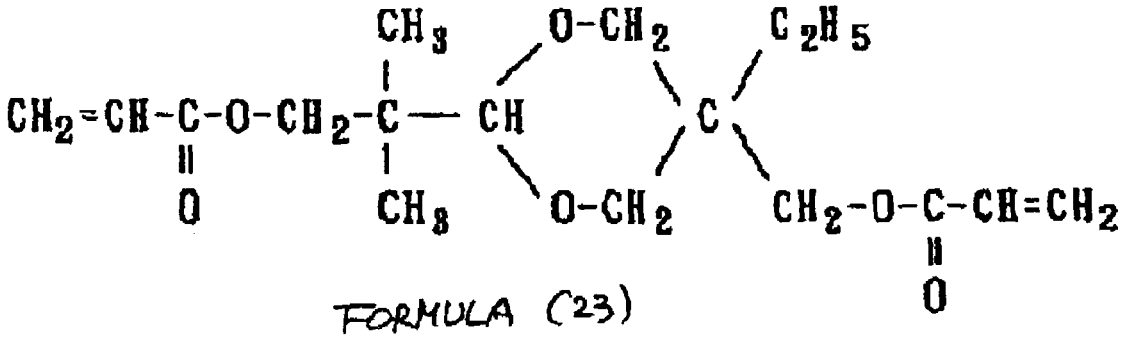
Figure 32:
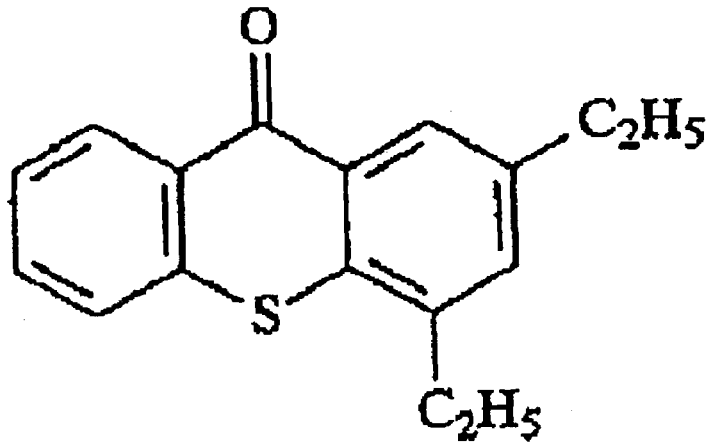

A drum 17 was identical with the drum 1 except for the composition of the protection layer coating liquid. conductive tin oxide and polymeric acrylic monomers represented by formulae (22) and (23) shown in FIGS. 31 and 30, respectively, were dispersed in ethanol such that the ratio of tin oxide to the total amount of resin was 5/2. The acrylic monomers were blended in a ratio of 3/2 (by weight). 15 wt % of hardener represented by a formula (24) shown in FIG. 32 was added to the resin. The resulting coating liquid was coated on the charge transporting layer and then cured by ultraviolet rays to thereby form a 3 μm thick charge injection layer or protection layer. The charge injection layer had volmetric resistance of $9\times10^{12}$ Ω·cm in a 23° C., 65% humidity environment.

<Drum 18>

A drum 18 was identical with the drum 1 except for the composition of the protection layer coating liquid. Ultra-fine $SnO_2$ grains and ethylene tetrafluoride having a grain size of about 0.25 μm were dispersed in photo-curable acrylic resin. More specifically, there was prepared $SnO_2$ grains with a grain size of about 0.03 μm in which antimony was doped to lower resistance. 167 parts of the $SnO_2$ grains thus prepared, 10 parts of tetrafluoroethylene and 1.2 parts of dispersant were dispersed in 100 parts of resin. The resulting coating liquid was coated to thickness of about 3.0 μm by spray coating to thereby form the charge injection layer or protection layer. The charge injection layer had volmetric resistance of $7\times10^{12}$ Ω·cm in a 23° C., 65% humidity environment.

<Drum 19>

A drum 19 was identical with the drum 1 except for the composition of the protection layer coating liquid.

Protection layer coating liquid

An intermediate layer with about 2000 Å thickness was provided by coating a mixed liquid comprising 2 parts of zirconium acetylacetone, 1 part of γ-methacryloxypropyltrimethoxy silane and 40 parts of n-butanol, followed by drying at 100° C. for two hours. While, a copolymer solution of styrene (st)-methylmethacrylate (MMA)-2-hydroxyetheylmethacrylate (2-HEMA), grains of tin oxide (a product of Mitsubishi Metal Mining.

The charge injection layer had volmetric resistance of $8\times10^{12}$ Ω·cm in a 23° C., 65% humidity environment.

<Drum 20>

A drum 20 was identical with the drum 1 except for the protection layer coating liquid.

Protection Layer Coating Liquid

Figure 33:
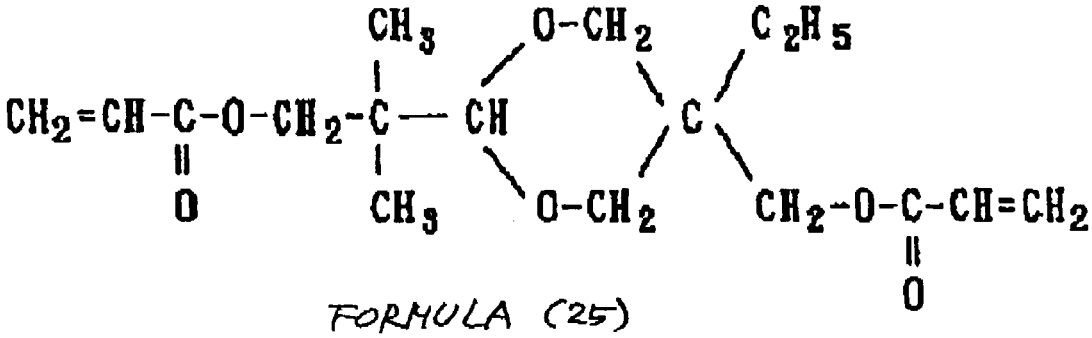
Figure 34:
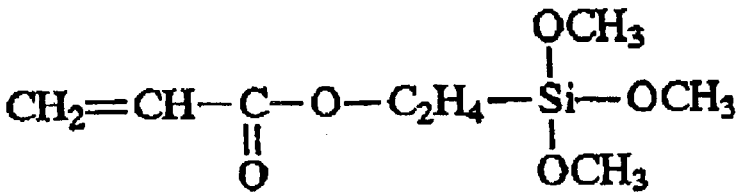

A mixed liquid for the transporting layer was obtained by dispersing 60 parts of acrylic monomer of formula (25) shown in FIG. 33, 30 parts of tin oxide super-fine particles (0.02 μm average particle size) surface treated by means of the wet treatment using a silane compound (15% in weight ratio to tin oxide) of formula (26) shown in FIG. 34, 10 parts of 2-methylthioxantone as the photopolymerization initiator, 100 parts of toluene and 200 parts of methyl cellosolve, in the sand mill for 48 hours. Then, the mixed liquid was coated on the charge transporting layer by means of spray coating to form the film, dried and irradiated with light at the intensity of 8 mW/cm$^2$ using a high pressure mercury lamp for 20 seconds for curing to form the 3 μm thick charge injection layer (transporting layer).

The charge injection layer had volmetric resistance of $1\times10^{12}$ Ω·cm in a 23° C., 65% humidity environment.

The drums 1 through 20 described above were mounted to an image forming apparatus lacking the air conditioning means 11 and an image forming apparatus including it. Running tests were conducted by using a developer used in a copier IMAGIO MF2200 available from RICOH Co. Ltd., VD of −700 V, a bias for development of −500 V, and a lattice chart having an image area ratio of 6%. Images were printed on paper sheets. Estimation was conducted after continuous running corresponding to 200,000 rotations in a 30° C., 90% humidity environment, i.e., a hot, humid environment.

The charging means was implemented as a contact type charge roller for the drums 1 through 14. For the drums 15 through 20, the following charging member was used in accordance with injection charging. 100 parts of magnetite was mixed with 100 part's of polystyrene resin, kneaded and then pulverized to prepare magnetic grains whose resistance was $1\times10^6$ Ω. The magnetic grains thus prepared were coated on a magnet roller to thickness of 1 mm to thereby form a magnet brush. An about 2 mm wide nip for charging was formed between the magnet brush and the drum. The magnet brush was rotated at the same peripheral speed of the surface of Lhe drum in the opposite direction, so that the magnet brush and drum uniformly contacted each other.

FIG. 35 shows the results of estimation as to image quality and the amount of wear (converted to values for 100,000 rotations). The amount of wear was determined on the basis of thickness before and after the running test for 100,000 rotations. Thickness was measured by use of a Fisher scope EDDY560C (trade name) available from Fisher. As shown, the drums 1, 2 and 8 with low wear resistance noticeably wore each and brought about background contamination and were critically low in durability. When the drum with high wear resistance in accordance with the present invention was mounted to the image forming apparatus lacking the air conditioning means, wear resistance was improved, but the blur of an image and toner filming occurred in the hot, humid environment while a leak image occurred in the case of injection charging. By contrast, by mounting the drum of the present invention to the image forming apparatus including the air conditioning means, it was possible to obviate blur, toner filming and leak images for thereby enhancing image quality.

In summary, it will be seen that the present invention provides an image forming apparatus having various unprecedented advantages, as enumerated below.

(1) Air conditioning means removes moisture around a photoconductive drum to thereby reduces various undesirable occurrences ascribable to much moisture, e.g., the generation of nitric acid, nitrate and other ionic substances ascribable to the coupling of nitric compounds derived from discharge with moisture and the generation of ammonium nitrate ascribable to the reaction of such ionic substances with ammonia. It is therefore possible to reduce the deposition of the ionic substances and ammonium nitrate on the drum as well as toner filming. It follows that even when some removing means for removing the ionic substances, ammonium nitrate and toner filming from the drum is absent and even when the drum is highly durable and wears only by about 0.05 μm to 0.5 μm for 100,000 rotations, high image quality can be preserved for a long time.

(2) The air conditioning means removes moisture inside a substantially hermetically closed, narrow space available in an image forming module. This reduces the size of the air conditioning means as well as power consumption.

(3) A filler is contained in a protection layer and enhances the mechanical durability and therefore wear resistance of the surface of the drum, thereby extending the life of the drum.

(4) A metal oxide is hard enough to enhance mechanical durability and is hydrophilic and therefore easily dissolves in a solvent, reducing light diffusion to thereby improve image quality. In addition, a metal oxide can be subject to various kinds of surface treatment and therefore adapt to improvement in dispersion and chargeability.

(5) Smooth transport of charges is promoted to lower residual potential. Therefore, a drum that remains stable in potential for a long time and electrostatically durable is achieved.

(6) The rise of residual potential can be reduced at the initial stage and after repeated operation. In addition, the filler can be desirably dispersed.

(7) A high molecular, charge transporting substance is highly wear-resistant and has a hard surface that suffers from a minimum of scratches, so that black stripes, white stripes and other image defects ascribable to scratches reduced.

(8) A protection layer formed of a crosslinking compound increases the surface hardness and therefore wear resistance of the drum.

(9) Discharge for charging the drum is not effected, so that the drum surface is free from deterioration ascribable to discharge, reducing the blur of an image. When the volmetric resistance of a charge injection layer is selected to be between $1\times10^8$ Ω·cm and $1\times10^{14}$ Ω·cm, sufficient chargeability is insured and causes a minimum of image running to occur.

(10) The charge injection layer contains conductive grains that reduces environment-dependency of resistance for thereby preventing chargeability and image from varying in accordance with the environment.

(13) The hard surface and wear-resistant coating, coupled with desirable dispersion of the conductive grains, provides the charge injection layer with an extremely uniform resistance distribution, thereby reducing the blur and irregularity of an image ascribable to a non-uniform resistance distribution.

Various modifications will become possible for those skilled in the art after receiving the teachings of the present disclosure without departing from the scope thereof.

What is claimed is:

1. An electrophotographic image forming apparatus, comprising:

an image forming module which has a case accommodating a photoconductive element, a developing unit, a charger, and a cleaning unit, wherein the image forming module has an image forming module inlet port and an image forming module outlet port;

wherein said case is provided with an opening for transferring a toner image onto a surface layer of said photoconductive element;

wherein said case is provided with a slit for allowing a laser beam issuing from a writing unit to reach the photoconductive element;

wherein said slit is covered with a transparent plate; and an air conditioning device for removing moisture around said photoconductive element inside said case;

wherein said air conditioning device comprises:

a case having an AC device case inlet port and an AC device case outlet port;

a dehumidifier which comprises condensing means, absorbing and conveying means for conveying condensed dew to the outside of the case of said air conditioning device;

wherein a part of said absorbing and conveying means is protruding to the outside of the case and wherein said part serves as an evaporating portion;

wherein the AC device case inlet port is connected with the image forming module outlet port and the AC device case outlet port is connected with the image forming module inlet port.

2. The apparatus as claimed in claim 1, wherein said photoconductive element comprises a conductive base, a photoconductive layer formed on an outer periphery of said base and containing a charge generating substance and a charge transporting substance, and said surface layer formed on an outer periphery of said photoconductive layer, wherein said surface layer comprises a charge injection layer having volmetric resistance of $1\times10^{8}$ μ·cm to $1\times10^{14}$ μ·cm.

3. The apparatus as claimed in claim 2, wherein said charge injection layer contains conductive grains and binder resin.

4. The apparatus as claimed in claim 3, wherein the binder resin comprises photo-curable or thermosetting acrylic resin.

5. The apparatus as claimed in claim 1, wherein said photoconductive element comprises a conductive base, a photoconductive layer formed on an outer periphery of said base and containing a charge generating substance and a charge transporting substance, and a protection layer formed on an outer periphery of said photoconductive layer as said surface layer, wherein said protection layer is formed of a crosslinking compound.

6. The apparatus as claimed in claim 5, wherein the crosslinking compound comprises a charge transporting substance including nitrogen atoms in a structure thereof.

7. The apparatus as claimed in claim 5, wherein said protection layer contains siloxane resin production by reaction of at least one of an organic silicon compound including a hydroxyl group or a hydrolytic group and a charge transporting compound including a reactive group.

8. The apparatus as claimed in claim 1, wherein said photoconductive element comprises a conductive base, a photoconductive layer formed on an outer periphery of said base, and a protection layer formed on an outer periphery of said photoconductive layer as said surface layer, wherein said protection layer contains a filler.

9. The apparatus as claimed in claim 8, wherein the filler comprises one of metal oxides.

10. The apparatus as claimed in claim 8, wherein said protection layer contains a charge transporting substance.

11. The apparatus as claimed in claim 8, wherein said protection layer contains a carboxylic acid compound.

12. The apparatus as claimed in claim 8, wherein said protection layer contains a high molecular, charge transporting substance.

13. The apparatus as claimed in claim 1, further comprising an image forming module having a substantially hermetically closed space thereinside, wherein said photoconductive element is disposed in said substantially hermetically closed space, and said air conditioning means removes moisture present in said substantially hermetically closed space.

14. The apparatus as claimed in claim 13, wherein said photoconductive element comprises a conductive base, a photoconductive layer formed on an outer periphery of said base and containing a charge generating substance and a charge transporting substance, and said surface layer formed on an outer periphery of said photoconductive layer, wherein said surface layer comprises a charge injection layer having volmetric resistance of $1\times10^{8}$ μ·cm to $1\times10^{14}$ μ·cm.

15. The apparatus as claimed in claim 14, wherein said charge injection layer contains conductive grains and binder resin.

16. The apparatus as claimed in claim 15, wherein the binder resin comprises photo-curable or thermosetting acrylic resin.

17. The apparatus as claimed in claim 13, wherein said photoconductive element comprises a conductive base, a photoconductive layer formed on an outer periphery of said base and containing a charge generating substance and a charge transporting substance, and a protection layer formed on an outer periphery of said photoconductive layer as said surface layer, wherein said protection layer is formed of a crosslinking compound.

18. The apparatus as claimed in claim 17, wherein the crosslinking compound comprises a charge transporting substance including nitrogen atoms in a structure thereof.

19. The apparatus as claimed in claim 17, wherein said protection layer contains siloxane resin production by reaction of at least one of an organic silicon compound including a hydroxyl group or a hydrolytic group and a charge transporting compound including a reactive group.

20. The apparatus as claimed in claim 12, wherein said photoconductive element comprises a conductive base, a photoconductive layer formed on an outer periphery of said base, and a protection layer formed on an outer periphery of said photoconductive layer as said surface layer, wherein said protection layer contains a filler.

21. The apparatus as claimed in claim 20, wherein the filler comprises one of metal oxides.

22. The apparatus as claimed in claim 20, wherein said protection layer contains a charge transporting substance.

23. The apparatus as claimed in claim 20, wherein said protection layer contains a carboxylic acid compound.

24. The apparatus as claimed in claim 20, wherein said protection layer contains a high molecular, charge transporting substance.

25. The apparatus as claimed in claim 1, further comprising scanning means scanning a document to thereby read an image of said document, and control means for causing said image read by said scanning means to be formed on a recording medium in accordance with image data derived from said image.

* * * * *